US007521867B2

(12) United States Patent
Sasaki et al.

(10) Patent No.: US 7,521,867 B2
(45) Date of Patent: Apr. 21, 2009

(54) PLASMA DISPLAY PANEL AND METHOD OF DRIVING AND PLASMA DISPLAY APPARATUS

(75) Inventors: Takashi Sasaki, Kawasaki (JP); Masayuki Shibata, Kawasaki (JP); Takahiro Takamori, Kawasaki (JP); Hideki Harada, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 628 days.

(21) Appl. No.: 10/936,698

(22) Filed: Sep. 9, 2004

(65) Prior Publication Data

US 2005/0062422 A1 Mar. 24, 2005

(30) Foreign Application Priority Data

Sep. 18, 2003 (JP) ..... 2003-326440
Apr. 30, 2004 (JP) ..... 2004-135321
Aug. 2, 2004 (JP) ..... 2004-225550

(51) Int. Cl.
*H01J 17/49* (2006.01)

(52) U.S. Cl. ..... 313/586; 313/582

(58) Field of Classification Search ..... 313/582–587; 345/60; 445/23–25

See application file for complete search history.

(56) References Cited

U.S. PATENT DOCUMENTS 5,306,984 A 4/1994 Lee
6,262,532 B1 * 7/2001 Park et al. ..... 313/585
6,628,077 B2 9/2003 Shirozu
6,670,754 B1 12/2003 Murai et al.
2002/0047591 A1 4/2002 Hirano et al.
2002/0135303 A1 9/2002 Hashimoto
2003/0146713 A1 8/2003 Nagao et al.

FOREIGN PATENT DOCUMENTS

CN 1230764 A 10/1999
CN 1359128 A 7/2002
EP 1 313 124 5/2003
JP 53-105170 9/1978
JP 53-105365 9/1978
JP 63-149053 9/1988

(Continued)

OTHER PUBLICATIONS

Chinese Office Action dated Sep. 1, 2006 in Chinese Application No. 2004100778813.

(Continued)

*Primary Examiner*—Joseph L Williams
(74) *Attorney, Agent, or Firm*—Staas & Halsey LLP

(57) ABSTRACT

A plasma display panel (PDP) not only capable of reducing a discharge start voltage but also of making the discharge start voltage uniform in each cell without being adversely affected by the variations in the distance between electrodes caused during manufacture has been disclosed, wherein a pair of electrodes, provided in each of a plurality of cells respectively in which a discharge is caused to occur selectively for display in a discharge space, has facing edges, respectively, provided for discharge and the distance between the facing edges changes when viewed from a direction perpendicular to a substrate and the edges in each of the plurality of cells have substantially the same shape.

5 Claims, 25 Drawing Sheets

FOREIGN PATENT DOCUMENTS

| | | | |
|---|---|---|---|
| JP | 3-233829 | | 10/1991 |
| JP | 4-92340 | | 3/1992 |
| JP | 4-267293 | | 9/1992 |
| JP | 7-029498 | | 1/1995 |
| JP | 11-96921 | | 4/1999 |
| JP | 11-126561 | | 5/1999 |
| JP | 2000-11899 | | 1/2000 |
| JP | 2000-357462 | | 12/2000 |
| JP | 2001-052623 | | 2/2001 |
| JP | 2001-084906 | | 3/2001 |
| JP | 2001-084907 | | 3/2001 |
| JP | 2002-8548 | | 1/2002 |
| JP | 2002-197981 | | 7/2002 |
| JP | 2003-229064 | | 8/2003 |
| JP | 2003-257321 | | 9/2003 |
| JP | 2001-071219 | | 3/2004 |
| JP | 2004205655 | * | 7/2004 |
| KR | 2003-0041060 | | 5/2003 |

OTHER PUBLICATIONS

Korean Office Action issued in Korean Patent Application 2006-024407661 dated Apr. 17, 2006.

Partial European Search Report, issued in corresponding European Patent Application No. 04255431.1, on Dec. 18, 2007.

Japanese Office Action issued on Dec. 2, 2008 in corresponding Japanese Patent Application 2004-135321.

* cited by examiner

PLASMA DISPLAY PANEL AND METHOD OF DRIVING AND PLASMA DISPLAY APPARATUS

BACKGROUND OF THE INVENTION

The present invention relates to an AC-type plasma display apparatus (PDP apparatus) used as a display unit of a personal computer or work station, a flat TV, or a plasma display for displaying advertisements, information, etc.

In an AC-type color PDP apparatus, an address/display separation system is widely adopted, in which a period for selecting cells to be used for display (address period) and a display period (sustain period) for causing a discharge to occur to light cells for display are separated. In this system, charges are accumulated in the cells to be lit during the address period and a discharge is caused to occur for display during the sustain period by utilizing the charges.

PDP apparatuses include: a two-electrode type apparatus in which a plurality of first electrodes extending in a first direction are provided in parallel to each other and a plurality of second electrodes extending in a second direction perpendicular to the first direction are provided in parallel to each other; and a three-electrode type apparatus in which a plurality of first electrodes and a plurality of second electrodes each extending in a first direction are provided, by turns, in parallel to each other and a plurality of third electrodes extending in a second direction perpendicular to the first direction are provided in parallel to each other. Recently, the three-electrode type PDP has become widely used. Moreover, a structure having more than three kinds of electrodes, including electrodes that play an auxiliary role, has been devised.

In a general structure of the three-electrode type PDP, first (X) electrodes and second (Y) electrodes are provided by turns in parallel to each other on a first substrate, third (address) electrodes extending in the direction perpendicular to the first and second electrodes are provided on a second substrate facing the first substrate, and each surface of the electrodes is covered with a dielectric layer. On the second substrate, one-directional stripe-shaped partitions extending in parallel to the third electrode are further provided between the third electrodes, or two-dimensional grid-shaped partitions arranged in parallel to the third electrodes and the first and second electrodes are provided so that the cells are separated from one another and after phosphor layers are formed between the partitions, the first and second substrates are bonded together to each other. Therefore, there may be a case where the dielectric layers and the phosphor layers and, further, the partitions, are formed on the third electrode.

After the charges (wall charges) in the vicinity of the electrode in each cell are brought into a uniform state by applying a voltage between the first and second electrodes and addressing is performed to selectively leave the wall charges in a cell to be lit by occurring discharges between the first, second and third electrodes by applying a scan pulse sequentially to the second electrode and applying an address pulse to the third electrode in synchronization with the scan pulse, a sustain discharge is caused to occur in the cell to be lit, in which the wall charges are left by the addressing, by applying a sustain discharge pulse that makes the neighboring electrodes, between which a discharge is to be caused to occur, have opposite polarities by turns. The phosphor layer emits light, which is seen through the first substrate, by the ultraviolet rays generated by the discharge. Because of this, the first and second electrodes are composed of an opaque bus electrode made of metal material and a transparent electrode such as an ITO film, and light generated in the phosphor layer can be seen through the transparent electrode. As the structure and operations of a general PDP apparatus are widely known, a detailed explanation will not be given here.

When a discharge gas is enclosed in a discharge space and a discharge is caused to occur between two electrodes, for example, in a PDP, it is known that the threshold voltage (the discharge start voltage) is determined based on the product of a distance d between two electrodes and a pressure p of the discharge gas, and a curve plotted as a graph to represent the change, where the horizontal axis denotes the product and the vertical axis denotes the discharge start voltage, is called the Paschen curve. In the Paschen curve, the discharge voltage reaches the minimum value for a certain value of the product (pd) of the distance d between two electrodes and the pressure p of the discharge gas and such a state is called the Paschen minimum.

In the configuration of the above-mentioned three-electrode type PDP, the transparent electrode of the first and second electrodes has, in general, a shape such that the edges of the electrodes are parallel and face each other at a distance d in each cell. The discharge voltage is obtained from the Paschen curve defined by the distance d and the pressure p of the discharge gas in the discharge space and the discharge start voltage between the first and second electrodes is determined. In this case, the discharge start voltage, determined based on the product pd, differs from cell to cell because there are variations in the distance d caused during the manufacture even if the designed value of the product pd in each cell is the same. As for the drive voltage in an actual PDP apparatus, therefore, the variations in the discharge start voltage being taken into account, the discharge start voltage is set higher than the Paschen minimum so that a discharge is caused to occur without fail even if there are variations in the discharge start voltage.

In Japanese Unexamined Patent Publication (Kokai) No. 2001-84907, for example, it is described that the product pd is set greater than the Paschen minimum in a three-electrode type PDP.

In a three-electrode type PDP, the space (called the reverse slit) between a pair of the first and second electrodes between which a discharge is caused to occur and its neighboring pair is set wide enough in order to prevent a discharge from occurring, but in Japanese Unexamined Patent Publication (Kokai) No. 2001-84906, a configuration is proposed in which a discharge is prevented from occurring in the inverse slit by narrowing the space so that the product pd becomes smaller than a value at which the Paschen minimum is reached and the discharge start voltage is increased.

Further, in Japanese Unexamined Patent Publication (Kokai) No. 2001-52623, it is described that the distance between the transparent electrodes of the first and second electrodes is set to a value at which the product pd is the Paschen minimum in a three-electrode type PDP.

As described above, the publicly known examples describe the distance between the third discharge electrodes in a three-electrode type PDP in which the first and second electrodes are provided by turns on the first substrate and the third electrodes are provided on the second substrate so as to intersect the first and second electrodes, but other PDPS having various configurations have been proposed. Japanese Unexamined Patent Publication (Kokai) No. 2003-36052, for example, describes a PDP which comprises: a first substrate, on which a plurality of first electrodes extending in a first direction are provided in parallel to each other, and after a dielectric layer is provided thereon, a plurality of second electrodes extending in a second direction perpendicular to the first direction are provided in parallel to each other, and a dielectric layer is further provided thereon; and a second substrate, on which a plurality of third electrodes extending in the first direction are provided in parallel to each other so as to face the first electrodes, and a dielectric layer is provided thereon. In this configuration, the first and second electrodes at which a discharge is caused to occur are configured so as to intersect each other via the dielectric layer, and the distance between two electrodes at the intersection is zero and the distance between two electrodes increases gradually as the distance from the intersection increases. Because of this, there must be a point at which the Paschen minimum is reached.

Moreover, Japanese Unexamined Patent Publication (Kokai) No. 2001-283735, describes a two-electrode type PDP which comprises: a first substrate, on which a plurality of first bus electrodes extending in a first direction are provided in parallel to each other and after a dielectric layer is provided thereon, a plurality of second bus electrodes extending in a second direction perpendicular to the first direction are provided in parallel to each other and a dielectric layer is provided thereon; and a second substrate having partitions and phosphor layers. At the intersection of the first and second bus electrodes, first and second transparent electrodes to be connected to the first and second bus electrodes, respectively, are provided and the first and second transparent electrodes have edges facing each other at a constant distance d. In Japanese Unexamined Patent Publication (Kokai) No. 2001-283735, the distance d between the first and second transparent electrodes is not described particularly, and there is no description of the Paschen curve and the Paschen minimum.

SUMMARY OF THE INVENTION

In the configurations described in the above-mentioned documents, the edges of two transparent electrode are facing each other at a constant distance d in each cell in which a sustain discharge is caused to occur. When the discharge gas pressure p=13,300 Pa, the Paschen minimum is reached when d=100 μm, and when the discharge gas pressure p=67,000 Pa, which is normally used, it is necessary to set d to 20 μm for the Paschen minimum to be reached. However, it is not easy for the current manufacturing technology to stably form a constant distance because of the variations caused during manufacture. In particular, when the distance becomes smaller, there is the possibility that neighboring electrodes may short-circuit. This reduces the production yield of the panel.

Moreover, a dielectric employing a conventional lead-base low melting point glass brings about a problem: the withstanding voltage is not sufficient when the distance between electrodes becomes small.

When the discharge gas pressure p is lowered, the Paschen minimum can be reached even if the distance d is increased, but this is not desirable because the decrease in the discharge gas pressure p generally causes the performance such as the light emitting efficiency and life to deteriorate.

As described above, in the prior art in which the edges of two transparent electrodes, between which a sustain discharge is caused to occur, face each other at a constant distance d, the influence of the variations in the distance d cannot be prevented. Moreover, due to the variations in the thickness of the coating phosphor, the variations occur also in the voltage of a discharge between facing electrodes. Therefore, in order for a discharge to be caused to occur without fail in each pixel, the drive voltage needs to be raised but, in such a case, a problem is brought about because the cost of the drive circuit is increased accordingly.

In the PDP described in the above-mentioned Japanese Unexamined Patent Publication (Kokai) No. 2003-36052, the first and second electrodes corresponding to the bus electrodes are formed so as to intersect with each other via the dielectric layer and no sustain electrode is provided, therefore, a discharge is caused to occur between the bus electrodes. The condition of the Paschen minimum is satisfied in the vicinity of the intersection, but as the first and second electrodes intersect each other at right angles, the distance between two electrodes increases rapidly as the distance from the intersection increases, therefore, a discharge is caused to occur only in the vicinity of the intersection and a discharge is unlikely to be caused to occur and propagate as described above. Moreover, as the amount of wall charges to be formed is limited, a problem arises: that is, the intensity of a discharge cannot be increased.

The object of the present invention is to reduce the discharge start voltage while maintaining the current discharge gas pressure p and at the same time to reduce the drive voltage by making uniform the discharge start voltage in each cell without the influence of the variations in the distance between electrodes caused during manufacture.

Moreover, another object, which relates to the solutions to the above-mentioned problems, is to simultaneously realize several accomplishments such as an increase in the degree of freedom in designing the structure of a back substrate, improvement in the panel life, increase in the display luminance, simplification of the manufacturing process, simplification of the drive circuit, and increase in stability of the discharge control.

In order to realize the above-mentioned objects, the plasma display panel (PDP) of a first aspect of the present invention is characterized in that a pair of electrode, between which a discharge is caused to occur, comprises edges facing each other, the distance between the facing edges changes and the shape of the electrode in each cell is substantially the same. The distance between edges is set so that product of the distance and the pressure of a discharge gas enclosed in a discharge space can take values on both sides of the Paschen minimum.

In other words, the plasma display panel (PDP) of the first aspect of the present invention comprises a first substrate, a second substrate arranged so as to face the first substrate and forming a discharge space between itself and the first substrate in which a discharge gas has been enclosed, a plurality of cells formed in the discharge space and in which a discharge is caused to occur selectively for display, and a pair of electrodes provided in each of the plurality of cells and controlling the discharge, wherein the pair of electrodes has edges facing each other between which a discharge is caused to occur, the distance between facing edges changes when viewed from a direction perpendicular to the first and second substrate, and the edges have substantially the same shape in each of the plurality of cells.

According to the first aspect of the present invention, a pair of electrodes has a shape in which the distance between the facing edges changes, and the product pd is set so as to be capable of taking values at both sides of the Paschen minimum, therefore, even if there are variations in the distance between facing edges, the condition of the Paschen minimum is satisfied without fail. Therefore, the drive voltage can be reduced because the discharge start voltage of the Paschen minimum is reached in all of the cells, the discharge start voltage can be made uniform in all of the cells, and the influence of the variations caused during manufacture can be ignored.

In Japanese Unexamined Patent Publication (Kokai) No. 7-29498, a plasma display panel having a pair of electrode for discharge, between which the distance changes gradually, is described, but there is no reference to the condition of the Paschen minimum and there is a problem that a uniform display cannot be produced on the entire screen because the distance between a pair electrodes for discharge changes from cell to cell.

Moreover, in Japanese Unexamined Patent Publication (Kokai) No. 3-233829, a gas discharge display element comprising a plurality of pairs of protruding electrodes the distance between which differs from each other is described, but there is no reference to the condition of the Paschen minimum and further there is a problem that light emission is initiated at the top end of the protruding electrode but the light emission does not propagate.

In contrast to this, in the plasma display panel of the first aspect of the present invention, the electrodes of the pair (the first discharge electrode and the second discharge electrode) have substantially the same shape in each cell and the distance between facing edges changes, therefore, it is possible to set the discharge start voltage of the Paschen minimum in all of the cells.

When the configuration of the first aspect of the present invention is applied to a three-electrode type PDP apparatus, the above-mentioned pair of electrodes is each made to correspond to an X electrode and a Y electrode at which a discharge is caused to occur, respectively. In this case, the pair of electrodes has a first electrode composed of a first bus electrode and a first discharge electrode provided so as to be connected to the first bus electrode, and a second electrode composed of a second bus electrode and a second discharge electrode provided so as to be connected to the second bus electrode, and a sustain discharge is caused to occur between the first discharge electrode and the second discharge electrode. Due to this, it is possible to set the sustain discharge start voltage to the Paschen minimum even if there are variations in the distance between the first and second discharge electrodes. A sustain discharge consumes more power than other discharges, therefore, if the drive voltage can be reduced, the effect of reduction in power consumption will be significant.

When the configuration of the first aspect of the present invention is applied to a three-electrode type PDP device, there are two possible configurations. In one of the configurations, third (address) electrodes are provided on a first substrate on which the first and second electrodes are provided, and in the other configuration, the third electrodes are provided on a second substrate facing the first substrate.

When the third electrodes are provided on the first substrate, first electrodes provided on the first substrate and composed of the first bus electrode and a first discharge electrode provided so as to be connected to the first bus electrode, and second electrodes provided on the first substrate and composed of the second bus electrode and a second discharge electrode provided so as to be connected to the plurality of second bus electrodes are provided and, further, the third electrodes provided on the first and second electrodes on the first substrate via a dielectric layer and composed of a third bus electrode extending in a direction substantially perpendicular to the direction in which the first and second bus electrodes extend so as to intersect the first and second bus electrodes and a third discharge electrode provided so as to be connected to the third bus electrode are comprised. In this case, it is possible to configure so that the distance between facing edges of the second discharge electrode and the third discharge electrode changes when viewed from a direction perpendicular to the first and second substrates.

In this configuration, it is possible to set the discharge start voltage of an address discharge to be caused to occur between the second discharge electrode and the third discharge electrode to the Paschen minimum. Moreover, as the second discharge electrode and the third discharge electrode are provided via the dielectric layer, they do not short-circuit even if the distance becomes zero (that is, if parts of them overlap each other).

The first bus electrode and the second bus electrode intersect with the third bus electrode, but partitions are provided so as to overlap the third bus electrode, therefore, no discharge is caused to occur between the first and second bus electrodes and the third bus electrode. The partitions can be those that are stripe-shaped and extend in the direction in which the third bus electrode extends or those that are two-dimensional grid-shaped and each extends in the direction in which the first and second bus electrodes extend and in the direction in which the third bus electrode extends, respectively. In the case of the two-dimensional grid-shaped partitions, if the intersection of the partitions is made to have a curved surface so that the width of the intersection is greater than those of other parts, it is possible to prevent a discharge between the first and second bus electrodes and the third bus electrode more certainly.

The configuration in which the third electrodes are provided on the second substrate is a three-electrode type configuration generally used conventionally. Like the configuration described above, first and second electrodes are provided on a first substrate and covered with a dielectric layer, and third electrodes are provided on a second substrate in a direction substantially perpendicular to the direction in which the first and second bus electrodes extend so as to intersect the first and second bus electrodes.

In this case, partition walls are provided between the third bus electrodes. The partitions can be those that are stripe-shaped and extending in the direction in which the third bus electrode extends or those that are two-dimensional grid-shaped and each extending in the direction in which the first and second bus electrodes extend and in the direction in which the third bus electrode extends, respectively. In the case of the two-dimensional grid-shaped partitions, if the intersection of the partitions is made to have a curved surface so that the width of the intersection is greater than those of other parts, it is possible to prevent a discharge between the first and second bus electrodes and the third bus electrode more certainly.

Grooves between partitions are coated with phosphor layers and displays are seen from the first substrate side. Due to this, the visible light generated by the phosphor layers on the second substrate can be seen through the first substrate, therefore, the thickness of the phosphor layer can be increased and the conversion efficiency is increased.

In order for the displays to be seen from the first substrate side, the first and second discharge electrodes need to have a transparent electrode that transmits light or an opening that passes light. When an opening is provided, it is possible to form the first and second discharge electrodes in the same layer using the same material as that of the first and second bus electrodes, therefore, the number of steps can be reduced. This applies to the third discharge electrodes when the third electrodes are provided on the first substrate.

There can be various modifications of the shapes of the first to third discharge electrodes.

The shape of the electrodes in each cell can be the same, but it is recommended to make the direction in which the distance between the facing edges of the first discharge electrode and the second discharge electrode increases opposite to that in the vertically or horizontally neighboring cell.

When the third electrodes are provided on the second substrate, it is recommended to arrange the third electrode in a cell so as to be shifted toward the side of narrower distances from the center of the facing edges of the first and second discharge electrodes when viewed in a direction perpendicular to the first and second substrates.

Moreover, for example, the distance between the facing edges of the first and second discharge electrodes is set to substantially 20 μm as the minimum value and 100 μm or less as the maximum value, or preferably, 50 μm or less. When the third electrodes are provided on the first substrate, the distance between the facing edges, of the second and third discharge electrodes, is set to substantially 0 μm as the minimum value and 100 μm or less as the maximum value or, preferably, 50 μm or less. The following explanation of the distance between the facing edges of the second and third discharge electrodes is given on the assumption that the third electrodes are provided on the first substrate.

When the shape of the facing edges of the first and second discharge electrodes or of the second and third discharge electrodes is linear, it is desirable that the two edges form a sharp angle of, preferably, approximately 20°.

The shape of the facing edges of the first and second discharge electrodes or of the second and third discharge electrodes can be curved or stepwise, in which the distance changes stepwise. When the edges are curved, it is desirable that the change in the distance is smaller toward the side of shorter distances and larger toward the side of longer distances.

It is desirable that the corners of the first and second sustain electrodes at which the distance between the facing edges is smallest are made curved, respectively.

Further, a shape is possible in which the first and second sustain electrodes or the second and third discharge electrodes have two pairs of linear edges, and in this case, one pair of edges is made to form a sharp angle, the other pair of edges is made to form an obtuse angle, that is, the edges are formed at an angle more than 90°.

Furthermore, when the third electrodes are provided on the first substrate, it is desirable that the drive capacitance is reduced by making the width at the intersection of the first and second bus electrodes and the third bus electrode narrower than those of other parts.

The dielectric layer that covers the first and second electrodes is a dielectric layer formed by the vapor phase film deposition method and is made to have a high withstand voltage with no possibility of dielectric breakdown so that the dielectric layer is not corroded even if an etching method is used for forming electrodes.

The first aspect of the present invention can be also applied to a so-called ALIS system PDP apparatus described in Japanese Patent No. 2801893, in which every space between the first bus electrode and the second bus electrode is used as a display line. In this case, each of the first discharge electrodes is provided with the first discharge electrode at both sides thereof and each of the second bus electrodes is provided with the second discharge electrodes at both sides thereof. In this case, the stripe-shaped partitions may be provided but when the two-dimensional grid-like partitions are provided, transverse partitions should be further arranged so as to overlap the first bus electrodes and the second bus electrodes by turns.

Moreover, the present invention can also be applied to a normal three-electrode type PDP apparatus, in which a space between one side of the first bus electrode and the other side of the second bus electrode is used as a display line. In this case, the first discharge electrode is provided at one side of each of the first bus electrodes and the second discharge electrode is provided at one side of each of the second bus electrodes near the side at which the first discharge electrode is provided. In this case also, the stripe-shaped and two-dimensional grid-shaped partitions may be provided and when the two-dimensional grid-shaped partitions are provided, transverse partitions should be further arranged at the space between the side of the first bus electrode at which the first discharge electrode is not provided and the side of the second bus electrode at which the second discharge electrode is not provided.

When the third electrode is provided on the first substrate, it is desirable that the third electrode is arranged at the side near to the discharge space.

When the third electrode is provided on the first substrate, it is desirable that the height of the partition is higher than a conventional three-electrode type PDP and no less than 150 μm and no more than 300 μm. Due to this, the phosphor layer to be formed on the second substrate is separated from a discharge to be caused to occur on the first substrate, and the damage of the phosphor by a discharge can be reduced and, at the same time, the light emission luminance can be increased because the area in which the phosphor is coated can be increased.

After the first and second substrates are bonded together to each other, it is necessary to form a passage for exhausting a space and enclosing a discharge gas. When the third electrodes are provided on the first substrate, it is possible to directly engrave the second substrate in order to form grooves that serve as a space in which a discharge is caused to occur and grooves that serve as a passage for exhausting the space and enclosing a discharge gas at the same time of the application of the phosphor to the second substrate because there is no electrode on the second substrate, and therefore, the manufacturing process can be simplified. Moreover, in this configuration, as the gap when the first and second substrates are bonded together to each other is very small, the seal material can be made extremely thin. Due to this, the necessity to use low-melting glass as a seal material, because the thickness of a conventional seal material is the same as the height of the partition, can be obviated, and the range of material selection can be widened because there is no limit to the selection of a seal material. As described above, by using a process in which the grooves are engraved in the second substrate, the necessity to use a glass material, including lead, as the dielectric layer, partitions and seal of the first and second substrates can be obviated, and there is the possibility of manufacturing of a panel without lead.

It is desirable that a discharge gas has a composition including at least neon (Ne) and xenon (Xe) and the mixing ratio of Xe is no less than 10%. Due to this, it is possible to prevent a rise in voltage by the Paschen minimum discharge while improving the luminance.

A PDP apparatus, which uses a plasma display panel having the first to third electrodes, comprises a first drive circuit for applying a voltage commonly to the first electrodes, a second drive circuit for applying a voltage to the second electrodes and a third drive circuit for applying a voltage to the third electrodes, wherein the second drive circuit applies a scan pulse sequentially to the second electrodes, the third drive circuit applies an address pulse to the third electrodes in synchronization with the scan pulse to select a cell to be lit at the intersection of the second electrode to which the scan pulse has been applied and the third electrode to which the address pulse has been applied by causing an address discharge to occur in the cell, and the first drive circuit and the second drive circuit cause a sustain discharge to occur repeatedly in the selected cell to be lit by applying a sustain pulse alternately to the first electrode and the second electrode.

As for the control of a discharge, various drive methods can be applied in order to speed up and stabilize a discharge, etc., and it is desirable to perform, for example, a drive method in which a weak discharge is caused to occur in a cell in which no address discharge has been caused to occur between an address discharge and a sustain discharge.

Further, it is desirable that a scan pulse to be applied to the second electrode during an address period has the negative polarity and the potential of which is lower than the potential of a sustain pulse to be applied to the second electrode during a sustain discharge period. Due to this, it is possible to cause an address discharge to occur without fail.

Furthermore, a reset period is made up of a process for forming a predetermined amount of wall charges in the vicinity of each electrode and a process for adjusting the amount of wall charges, and the maximum potential difference to be applied between the second and third electrodes in the process for adjusting the amount of wall charges is made greater than the difference between the potential to be applied to the third electrode during the address period and the potential of the second electrode other than the second electrode to which the scan pulse is to be applied. Due to this, it is possible to prevent an address discharge from occurring in a cell not selected.

When the distance between the facing edges of the X discharge electrode and the Y discharge electrode which are provided at a same layer is changed as described above, it becomes apparent that a production yield of the plasma display panel is decreased when the plasma display panel is produced under a present production technique because a short-circuit occurs between the facing edges of the X discharge electrode and the Y discharge electrode at a side of which distance is narrower. This problem will be solved by an advance of the production technique, but it is difficult to produce the plasma display panel of the first aspect with a high yield. A plasma display panel of a second aspect of the present invention has a constitution in which a discharge start voltage of an address discharge is set to the Paschen minimum without the decrease of the production yield when the plasma display panel is produced under the present production technique.

The plasma display panel of the second aspect of the present invention is constituted so that the panel comprises: a first substrate; a second substrate arranged so as to face the first substrate and forming discharge spaces in which a discharge gas is enclosed between the second substrate and the first substrate, and the first substrate comprises first electrodes consisting of first bus electrodes and first discharge electrodes provided so as to be connected to the first bus electrodes; second electrodes consisting of second bus electrodes and second discharge electrodes provided so as to be connected to the second bus electrodes; a dielectric layer covering the first and second electrodes; and third electrodes provided on the dielectric layer and consisting of third bus electrodes extending in a direction substantially perpendicular to the direction in which the first and second bus electrodes extend so as to intersect the first and second bus electrodes; and third discharge electrodes provided so as to be connected to the third bus electrode, and wherein the second discharge electrode and the third discharge electrode have facing edges, the distance between the edges changes, and the first discharge electrode and the second discharge electrode have facing edges, the distance between the edges is constant, when viewed from a direction perpendicular to the first and second substrates.

In the above constitution, the third electrodes can be constituted only by the third bus electrodes so that the distance between the facing edges of the second discharge electrode and the third bus electrode changes.

According to the second aspect, it is possible to set the discharge start voltage of an address discharge to be caused to occur between the second discharge electrode and the third discharge electrode (or the third bus electrode) to the Paschen minimum. Moreover, as the second discharge electrode and the third discharge electrode (or the third bus electrode) are provided via the dielectric layer, they do not short-circuit even if the distance becomes zero (that is, if parts of them overlap each other). Because the facing edges of the first discharge electrode and the second discharge electrode is parallel and the distance thereof is relatively large, a short-circuit does not occur between the first discharge electrode and the second discharge electrode.

The distance between the facing edges of the second discharge electrode and the third discharge electrode (or the third bus electrode) is desirable to be narrower at a side nearer to the first discharge electrode. According to this constitution, the address discharge between the second discharge electrode and the third discharge electrode (or the third bus electrode) occurs at a position near the first discharge electrode, and the address discharge easily induces a discharge between the first discharge electrode and the second discharge electrode.

The distance between the second discharge electrode and the third bus electrode of a neighboring column is wider than the maximum distance between facing edges of the second discharge electrode and the third discharge electrode (or the third bus electrode). According to this constitution, an erroneous discharge between the second discharge electrode and the third discharge bus electrode of the neighboring column can be avoided.

The distance between the third discharge electrode and the second bus electrode is desirable to be wider than the maximum distance between facing edges of the second discharge electrode and the third discharge electrode. According to this constitution, an erroneous discharge between the third discharge electrode and the second bus electrode can be avoided.

It is desirable to further provide partitions arranged at intersections of the first and second bus electrodes and the third bus electrode. According to this constitution, an erroneous discharge between the first and second discharge electrodes and the third bus electrode can be avoided.

BRIEF DESCRIPTION OF THE DRAWINGS

The features and advantages of the invention will be more clearly understood from the following description taken in conjunction with the accompanying drawings, in which.

DESCRIPTION OF THE PREFERRED EMBODIMENTS

In a first embodiment of the present invention, the present invention is applied to an ALIS system PDP device described in Japanese Patent No. 2801893, in which third electrodes (address electrodes) are provided on a first substrate (a transparent substrate) together with first and second electrodes (X and Y electrodes). As the ALIS system is described in the above-mentioned document, a detailed explanation is not given here.

Figure 1:
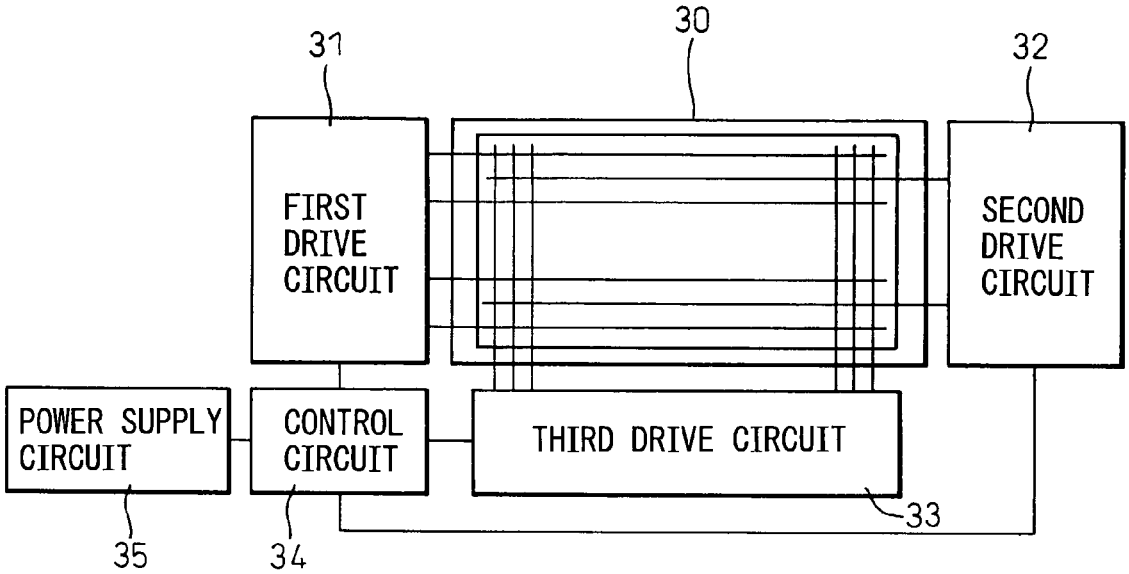
FIG. 1 is a diagram showing a general configuration of a PDP apparatus according to a first embodiment of the present invention.

FIG. 1 is a diagram showing a general configuration of a plasma display apparatus (PDP apparatus) in the first embodiment of the present invention. As shown schematically, a plasma display panel 30 comprises a group of first electrodes (X electrodes) and a group of second electrodes (Y electrodes) extending in the transverse direction (the direction of the length) and a group of third electrodes (address electrodes) extending in the longitudinal direction. The group of X electrodes and the group of Y electrodes are arranged by turns and the number of the X electrodes is one more than that of the Y electrodes. The group of X electrodes are connected to a first drive circuit 31 and are divided into a group of odd-numbered X electrodes and a group of even-numbered X electrodes, and each group are driven commonly. The group of Y electrodes are connected to a second drive circuit 32 and a scan pulse is applied sequentially to each of the Y electrode and at the same time, the group of Y electrodes are divided into a group of odd-numbered Y electrodes and a group of even-numbered Y electrodes except when a scan pulse is applied, and each group are driven commonly. The group of address electrodes are connected to a third drive circuit 33 and an address pulse is applied thereto independently in synchronization with a scan pulse. The first to third drive circuits 31 to 33 are controlled by a control circuit 34 and each circuit is supplied with power from a power supply circuit 35.

Figure 2:
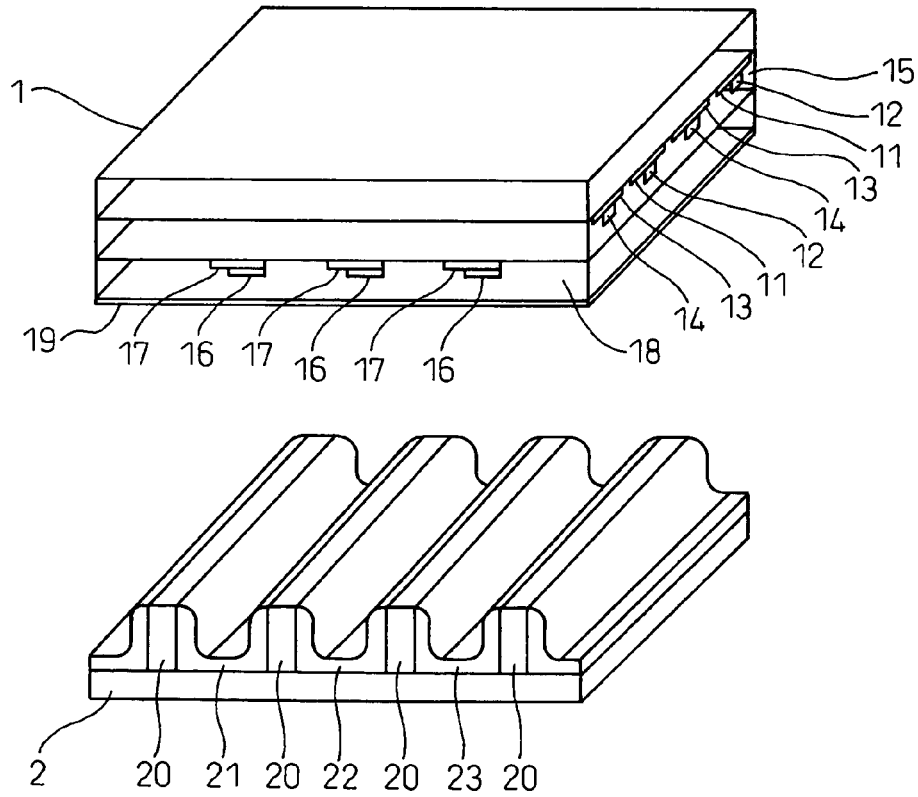
FIG. 2 is an exploded perspective view of the PDP according to the first embodiment.

FIG. 2 is an exploded perspective view of the plasma display panel (PDP) 30. As shown schematically, on a front (first) glass substrate 1, first (X) bus electrodes 14 and second (Y) bus electrodes 12 extending in the transverse direction are arranged by turns in parallel to each other. X and Y light-transmitting electrodes (discharge electrodes) 13 and 11 are provided so as to overlap the X and Y bus electrodes 14 and 12, and part of the X discharge electrode 13 and part of the Y discharge electrode 11 protrude from both sides of the X bus electrode 14 and the Y bus electrode 12, respectively. The X and Y bus electrodes 14 and 12 are formed, for example, by a metal layer, the discharge electrodes 13 and 11 are formed by an ITO layer film etc., and the resistance of the X and Y bus electrodes 14 and 12 is less than or equal to the resistance of the discharge electrodes 13 and 11. Hereinafter, the part of the X discharge electrode 13 extruding from both sides of the X bus electrode 14 and the part of the Y discharge electrode 11 extruding from both sides of the Y bus electrode 12 are simply referred to as the X discharge electrode 13 and the Y discharge electrode 11, respectively.

On the discharge electrodes 13 and 11, and the bus electrodes 14 and 12, a first dielectric layer 15 is formed so as to cover them. The first dielectric layer 15 is composed of $SiO_2$ that transmits visible light etc., and is formed by the vapor phase film deposition method. Among the vapor phase film deposition methods for forming the first dielectric layer 15, the CVD method, particularly, the plasma CVD method is suitable and, using these methods, it is possible to make the thickness of the first dielectric layer 15 approximately 10 μm or less. In general, the thickness of a dielectric layer formed by a method other than the conventional vapor phase film deposition method is approximately 30 μm. Recently, it has been found by an electric field simulation that the shape of an electric field to be formed on the surface of a dielectric is not necessarily one in accordance with the shape of an electrode because of the influence of the thickness of the dielectric layer. In other words, when a dielectric layer is thick, it is difficult to exactly control the electric field on the dielectric and it is also difficult to set the distance between neighboring electrodes so as to meet the condition of Paschen minimum. In contrast to this, a dielectric layer formed by the vapor phase film deposition method can be thin, therefore, it is possible to exactly control the electric field on the dielectric layer and it is easy to set the condition of the Paschen minimum.

On the first dielectric layer 15, third (address) bus electrodes 16 and address light-transmitting electrodes (discharge electrodes) 17 are provided so as to intersect the bus electrodes 14 and 12. The address bus electrode 16 and the address discharge electrode 17 are provided so as to overlap each other and part of the address discharge electrode 17 protrudes from the address bus electrode 16. The address bus electrode 16 is formed, for example, by a metal layer, the address discharge electrode 17 is formed by an ITO layer film etc., and the resistance of the address bus electrode 16 is less than or equal to the resistance of the address discharge electrode 17. Similarly, the part of the address discharge electrode 17 extruding from both sides of the address bus electrode 16 is simply referred to as the address discharge electrode 17.

There are some cases where neither the X discharge electrode nor the Y discharge electrode is provided at the upper and lower ends but a plurality of X and Y bus electrodes are arranged as a dummy electrode, or no address discharge electrode is provided at the right and left ends but a plurality of address bus electrodes are arranged as a dummy electrode.

The surface of the first dielectric layer 15 formed by the vapor phase film deposition method is smooth and it is easy to form the group of X electrodes and the group of Y electrodes. Further, the first electrode layer 15 is not corroded by a wet etchant, other than hydrofluoric acid and, therefore, it is unlikely that the first dielectric layer 15 transforms in quality even in the process for forming the group of X electrodes and the group of Y electrodes. Furthermore, the first dielectric layer 15 formed by the vapor phase film deposition method can be made thinner than a generally used conventional dielectric layer formed by baking, therefore, there is a small difference in height at the slope part of the first dielectric layer 15 and in this respect also, it is easy to form the group of address electrodes. Moreover, the dielectric constant is as low as about one third that of a general lead-base low-melting point glass, therefore, the increase in capacitance is small even if electrodes are formed at both sides so as to sandwich the dielectric layer, and it is easy to drive.

On the group of address electrodes, a second dielectric layer 18 is formed by the vapor phase film deposition method and a protective layer 19 such as MgO is further formed thereon. The protective layer 19 releases electrons by ion bombardment to cause a discharge and has the effects of that the discharge voltage is reduced, the delay in discharge is prevented to a certain extent, etc. In this structure, as all of the electrodes are covered with the protective layer 19, it is possible to cause a discharge to occur by making use of the effects of the protective layer even if an electrode group becomes the cathode. As describe above, it is easy to arrange electrodes at both sides of the first dielectric layer 15 formed by the vapor phase film deposition method and the dielectric layer 15 can be used as a front substrate because it easily transmits visible light.

On the other hand, on a back (second) substrate 2, partitions 20 are formed in the longitudinal direction. The sides and bottom of a groove formed by the partitions 20 and the back substrate 2 is coated with one of phosphor layers 21, 22 and 23 excited by ultraviolet rays generated during a discharge and generating red, green and blue visible light, respectively.

Figure 3:
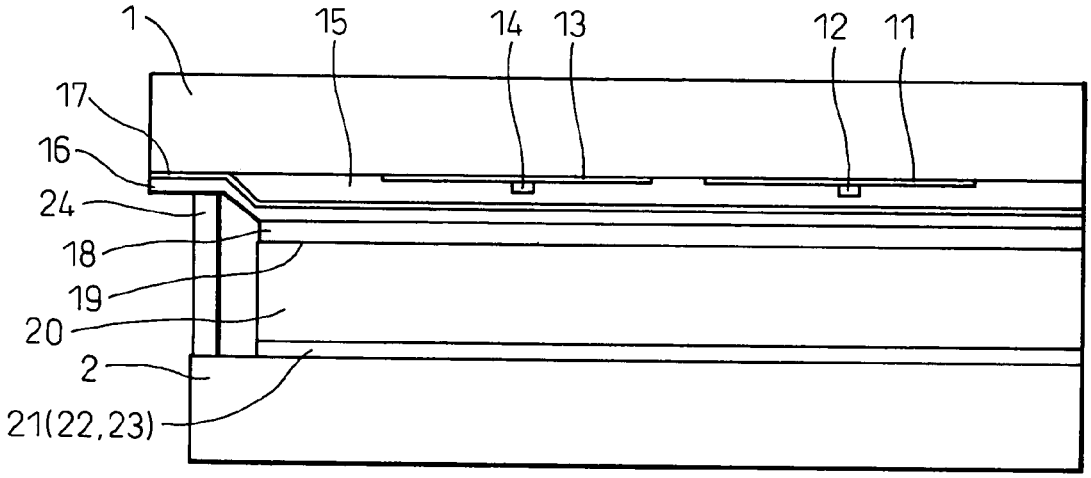
FIG. 3 is a sectional view (in the longitudinal direction) of the PDP according to the first embodiment.
Figure 4:
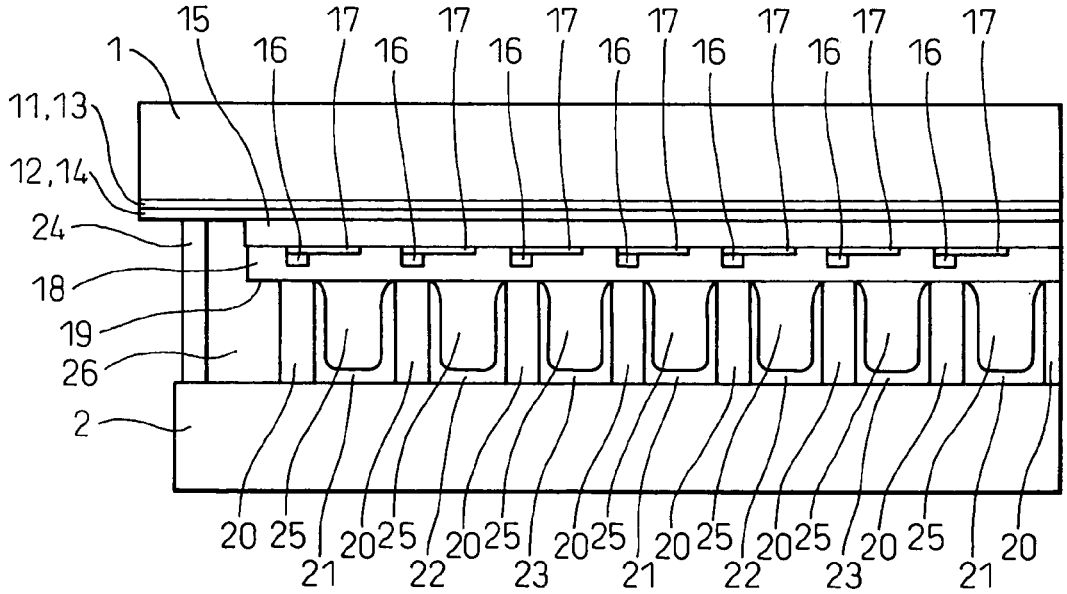
FIG. 4 is a sectional view (in the transverse direction) of the PDP according to the first embodiment.

FIG. 3 is a partly longitudinal sectional view of the PDP 30 in the first embodiment and FIG. 4 is a partly transverse sectional view thereof. The front substrate 1 and the back substrate 2 are sealed by a seal 24 and a discharge gas such as Ne, Xe and He is enclosed in a discharge space 25 surrounded by the partitions 20. It is desirable that the mixing ratio of Xe is no less than 10% in the discharge gas. The address bus electrodes 16 are arranged so as to overlap the longitudinal partitions 20. As shown schematically, the group of address electrodes are arranged at the side nearer to the discharge space than the group of X electrodes and the group of Y electrodes.

Figure 5:
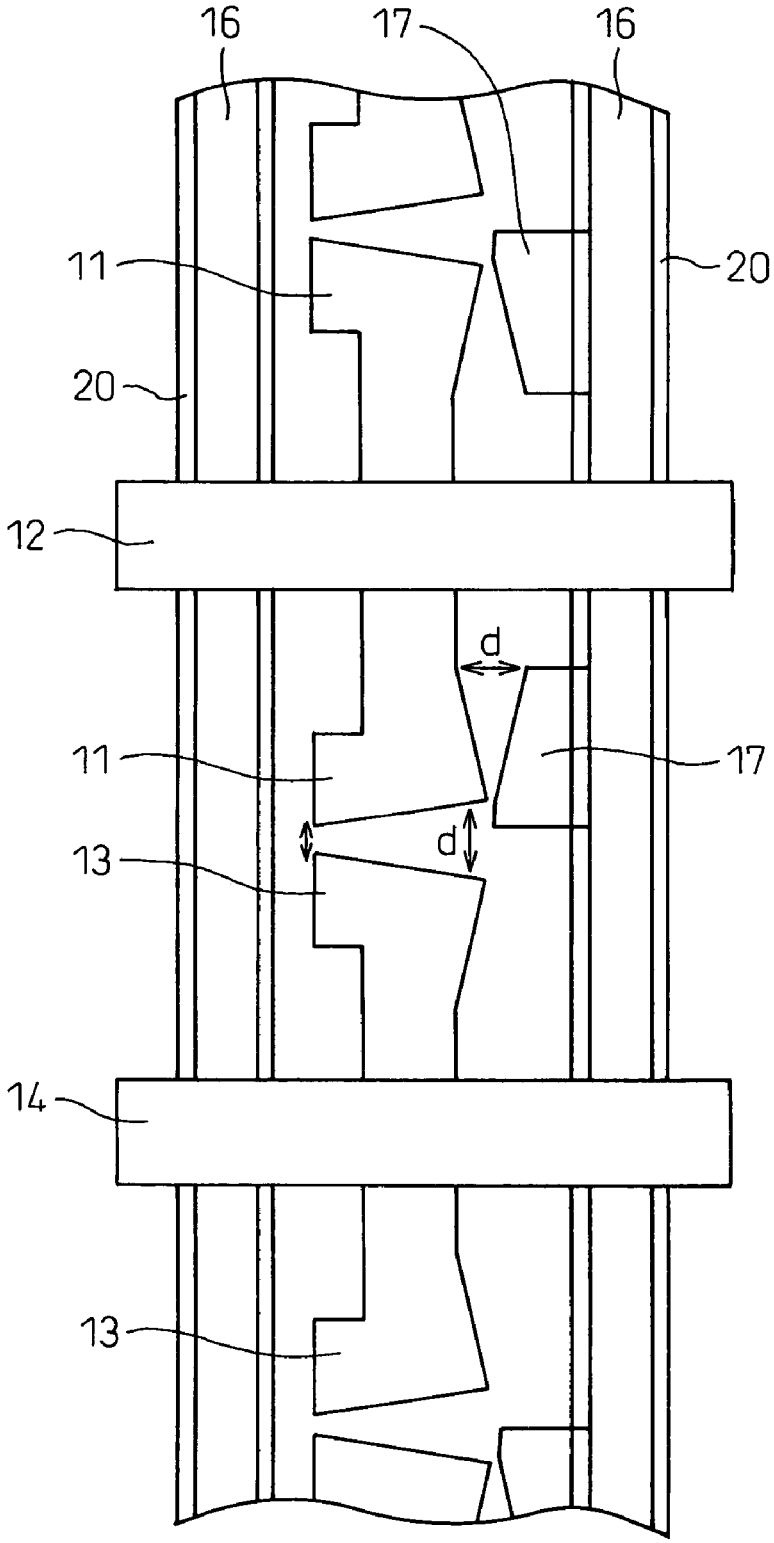
FIG. 5 is a diagram showing the shape of electrodes according to the first embodiment.

FIG. 5 is a part top plan view showing the structure of a cell and the shape of electrodes. As shown schematically, the Y bus electrodes 12 and the X bus electrodes 14 are arranged by turns in parallel to each other and the Y light-transmitting discharge electrode 11 and the X light-transmitting discharge electrode 13 extrude from both sides of each of the bus electrodes, respectively. The Y discharge electrode 11 and the X discharge electrode 13 protruding so as to face each other are formed so that the distance between the facing edges gradually changes, that is, the distance between the edges has a plurality of values. The connection part of the X discharge electrode and the bus electrode and that of the Y discharge electrode and the bus electrode are made narrower than other parts. In the present embodiment, the facing edges of the electrodes 11 and 13 are configured so as to form a sharp angle less than 90° so that both the edges are close at one end and a predetermined distance d separate from each other at the other end. It is desirable that the distance d between electrodes is, for example, approximately 20 μm at the end where both the edges are closest and approximately 100 μm. or preferably, 50 μm at the other end. As the length of the facing edges of the electrodes 11 and 13 is approximately 100 μm, the angle the facing electrode edges form is a sharp angle much less than 90° and it is desirable that the angle is approximately 20°. As will be described later, the distance d between electrodes is a value that is determined based on the relationship with the pressure of a discharge gas to be enclosed according to the Paschen's law, and this dimension is one of examples. Moreover, instead of linear edges, the facing edges can be stepwise, which will be described later, or curved as long as the distance between electrodes changes. In the case of stepwise edges, the facing edges are parallel to each other and the angle formed by the edges is substantially 0°.

On the X and Y bus electrodes 14 and 12, and the X and Y discharge electrodes 13 and 11, the first dielectric layer 15 is formed, and the address bus electrodes 16 and the address discharge electrodes 17 extending in a direction substantially perpendicular to the X and Y bus electrodes 14 and 12 are arranged thereon, and as shown schematically, the address discharge electrode 17 protrudes from the address bus electrode 16 so as to face the Y discharge electrode 11. The Y discharge electrodes 11 and the address bus electrodes 16 are formed so that the distance between the facing edges changes gradually, that is, the distance between the edges changes continuously and the distance has a plurality of different values. In the present embodiment, the facing edges of the electrodes 11 and 17 are configured so as to form a sharp angle less than 90° so that both edges are close at one end and a predetermined distance d separate from each other at the other end. As the Y discharge electrodes 11 and the address discharge electrodes 17 are insulated from each other by the first dielectric layer 15 in between, the distance between electrodes can be zero at the end where both edges are closest. The distance at the other end is approximately 100 μm or preferably, 50 μm. As the length of the facing edges of the electrodes 11 and 13 is approximately 100 μm, the angle the facing electrode edges form is a sharp angle much less than 90° and, preferably, the angle is approximately 20°. Similar to the case of the X discharge electrodes and the Y discharge electrodes, the distance d between electrodes is a value that is determined based on the relationship with the pressure of a discharge gas to be enclosed, according to the Paschen's law, and this dimension is one of examples. Moreover, instead of linear edges, the facing edges can be stepwise or curved as long as the distance between electrodes changes. In the case of stepwise edges, the facing edges are parallel to each other and the angle formed by the edges is substantially 0°.

Further, the distance between the facing edges of the Y discharge electrode 11 and the address discharge electrode is narrower at a side nearer to the first discharge electrode. Therefore, the address discharge between the Y discharge electrode 11 and the address discharge electrode 17 occurs at a position near the first discharge electrode. This discharge easily induces a discharge between the X discharge electrode 13 and the Y discharge electrode 11.

The address bus electrodes 16 are arranged so as to overlap the longitudinal partitions 20 that separate pixels in the transverse direction. Due to this, the intersections of the address bus electrodes 16 and the X and Y bus electrodes 14 and 12 are covered with the longitudinal partitions 20 and are not exposed to the discharge spaces. Because of this, discharges originating from the bus electrodes can be prevented from occurring. If the widths of the intersections of the address bus electrodes 16 and the X and Y bus electrodes 14 and 12 are made narrower than those at other parts, the drive capacitance can be reduced.

Figure 6:
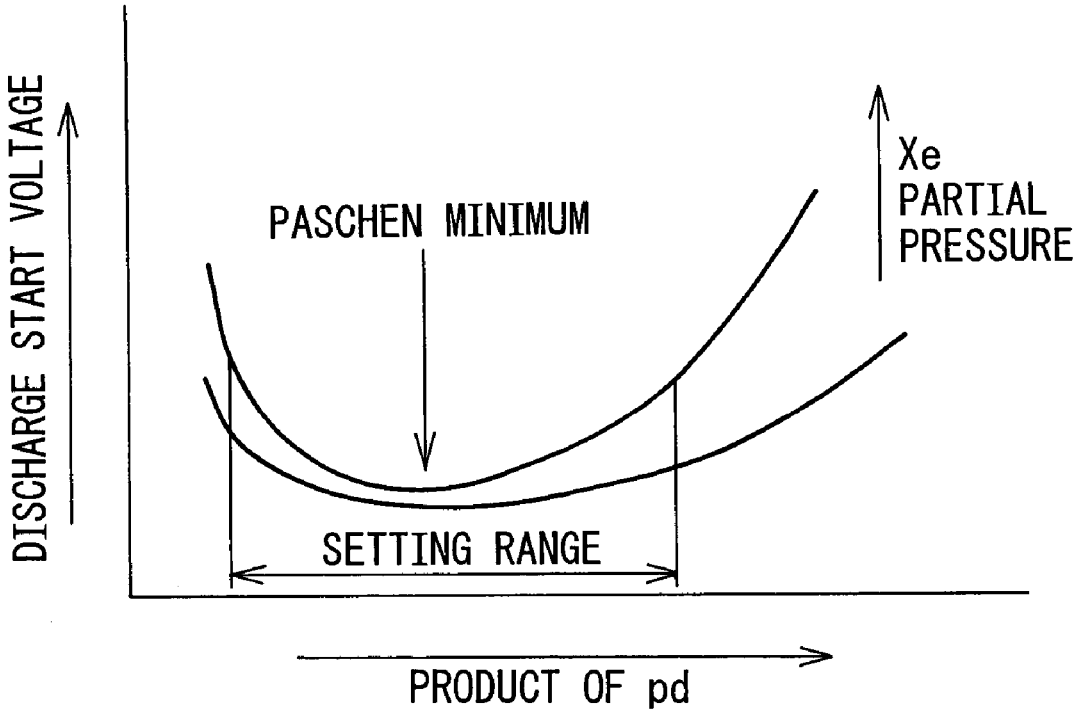
FIG. 6 is a diagram showing a Paschen curve.

The operation principles of the present invention are explained below with reference to FIG. 6. In FIG. 6, the horizontal axis denotes the product pd of the distance d between two electrodes between which a discharge is caused to occur and the pressure p of a discharge gas in a discharge space, the vertical axis denotes the discharge start voltage corresponding to the product pd, and the graph is called the Paschen curve. The discharge gas is a mixture of neon (Ne), xenon (Xe), helium (He), etc. When the composition (mixing ratio) of the discharge gas is constant, if the distance d between electrodes or the discharge gas pressure p changes, the discharge start voltage changes in accordance with the product pd and as the curve is convex downward as shown in FIG. 6, there exists the minimum discharge start voltage. The point at which the discharge start voltage becomes minimum is generally called the Paschen minimum. When the mixing ratio of the discharge gas changes in such a way that, for example, the partial pressure of Xe is increased, the tendency for the discharge start voltage to increase is exhibited, but the change in the discharge start voltage is small at the Paschen minimum.

In general, in an AC-type color PDP, as described in the above-mentioned document, d is designed to be constant and the product pd is set so as to be located to the right of the Paschen minimum. This is because a region is selected so that the change in the voltage against the product pd is only in one direction, that is, the voltage increasing direction or the voltage decreasing direction even if there are variations in the distance d between electrodes caused during manufacture. As an example of p and d for the product pd, approximately 67,000 Pa and 100 μm are selected, respectively. In this case, if the distance between electrodes is assumed to be constant, the discharge gas pressure at the Paschen minimum is approximately 13,300 Pa. In contrast to this, if the discharge gas pressure is set to 67,000 Pa, the distance d between electrodes is approximately 20 μm. Therefore, when the discharge gas pressure is set to 67,000 Pa and the distance between the facing edges of two light-transmitting electrodes changes from 0 μm to 100 μm as in the present embodiment, there must be a distance between electrodes at which the discharge start voltage reaches the Paschen minimum while the distance changes and a discharge with a low voltage is caused to occur as a result. Moreover, if the discharge gas pressure p is set to 40,000 Pa, the distance between electrodes at which the Paschen minimum is reached is approximately 30 μm, therefore, there must be a distance between electrodes at which the discharge start voltage reaches the Paschen minimum while the distance between electrodes changes from 20 μm to 100 μm, and a discharge with a low voltage can be caused to occur as a result.

Even if there are variations in the electrode dimensions caused during manufacturer, a discharge is caused to occur at the Paschen minimum without fail and, therefore, the variations in discharges in respective cells are reduced. Moreover, the delay in time between the instance at which a voltage is applied and the instance at which a discharge is caused to occur actually is reduced because the distance d between electrodes is small. Due to this, as the time required for addressing can be reduced particularly, it will be possible to increase the luminance by increasing the number of sustain discharges or increase the number of gradations.

In the present embodiment, as shown in FIG. 5, the facing edges of two discharge electrodes between which a discharge is caused to occur are made close to each other at one end and are separated along two surfaces that form a sharp angle so that they are approximately 100 μm separate at the other end, therefore, as described above, a discharge is caused to occur without fail at the Paschen minimum in each cell. The gas pressure p and the distance d between electrodes are only examples and any region can be set as long as the range of the product pd includes the Paschen minimum. For example, when the discharge gas pressure p is 40,000 Pa, the distance between electrodes at which the Paschen minimum is reached is approximately 30 μm and the minimum value of the distance between electrodes can be between 10 and 20 μm. The maximum value of the distance between electrodes can be approximately 50 μm, but it is desirable that the designed value is approximately 100 μm if the variations in the distance between electrodes caused during manufacture are taken into account. There is no upper limit to the distance between electrodes but the maximum distance is determined based on the dimensions of the cell itself. However, the lower the upper limit, the wider the range in which d is near the Paschen minimum, and the probability of discharge is increased.

In the present embodiment, it is desirable that the height of the partitions is approximately between 150 μm and 300 μm. In the conventional structure in which electrodes (address electrodes) are formed also on the back substrate, the height of the partition is approximately 150 μm in general in order for the voltage of a discharge caused to occur between electrode on the front substrate and that on the back substrate to be reduced. In contrast to this, in the present invention, as no electrode is provided on the back substrate, the height of the partitions can be made higher. Due to this, it is possible to prevent to a certain extent the deterioration in the quality of the phosphors due to the ion sputter of a discharge and as a result and the life is lengthened, because a sustain discharge on the front substrate is caused to occur at a great distance from the phosphor layers. The phosphor layers are formed on the partition sides and the bottom of the back substrate in the discharge space but if the partitions are excessively high, it is necessary to increase the thickness of the phosphors on the bottom more than is necessary, resulting in increase in wasteful man-hours. Therefore, it is desirable that the height of the partitions is approximately between 150 μm and 300 μm.

In each cell of a PDP, only the selection of the lit state or the unlit state is possible and the lighting luminance cannot be changed, that is, a gradated display cannot be produced. Therefore, one frame is divided into a plurality of subfields with a predetermined weight, and a gradated display is produced by combining the subfields to be lit in a frame for each cell. Each subfield normally has the same drive sequence.

As described above, the PDP apparatus in the present embodiment is of ALICE system type, and display lines are defined in all the spaces between the respective X electrodes and the respective Y electrodes. For example, a first display line is defined between the first X electrode and the first Y electrode, a second display line is defined between the first Y electrode and the second X electrode, a third display line is defined between the second X electrode and the second Y electrode, and a fourth display line is defined between the second Y electrode and the third X electrode. In other words, an odd-numbered display line is defined between an odd-numbered X electrode and the same odd-numbered Y electrode and between an even-numbered X electrode and the same even-numbered Y electrode, and an even-numbered display line is defined between an odd-numbered Y electrode and the next even-numbered X electrode and between an even-numbered Y electrode and the next odd-numbered X electrode. One display field is divided into an odd number field and an even number field, and in the odd number field, odd-numbered display lines are displayed and in the even number field, even-numbered display lines are displayed. The odd number field and the even number field are composed of a plurality of subfields, respectively.

Figure 7:
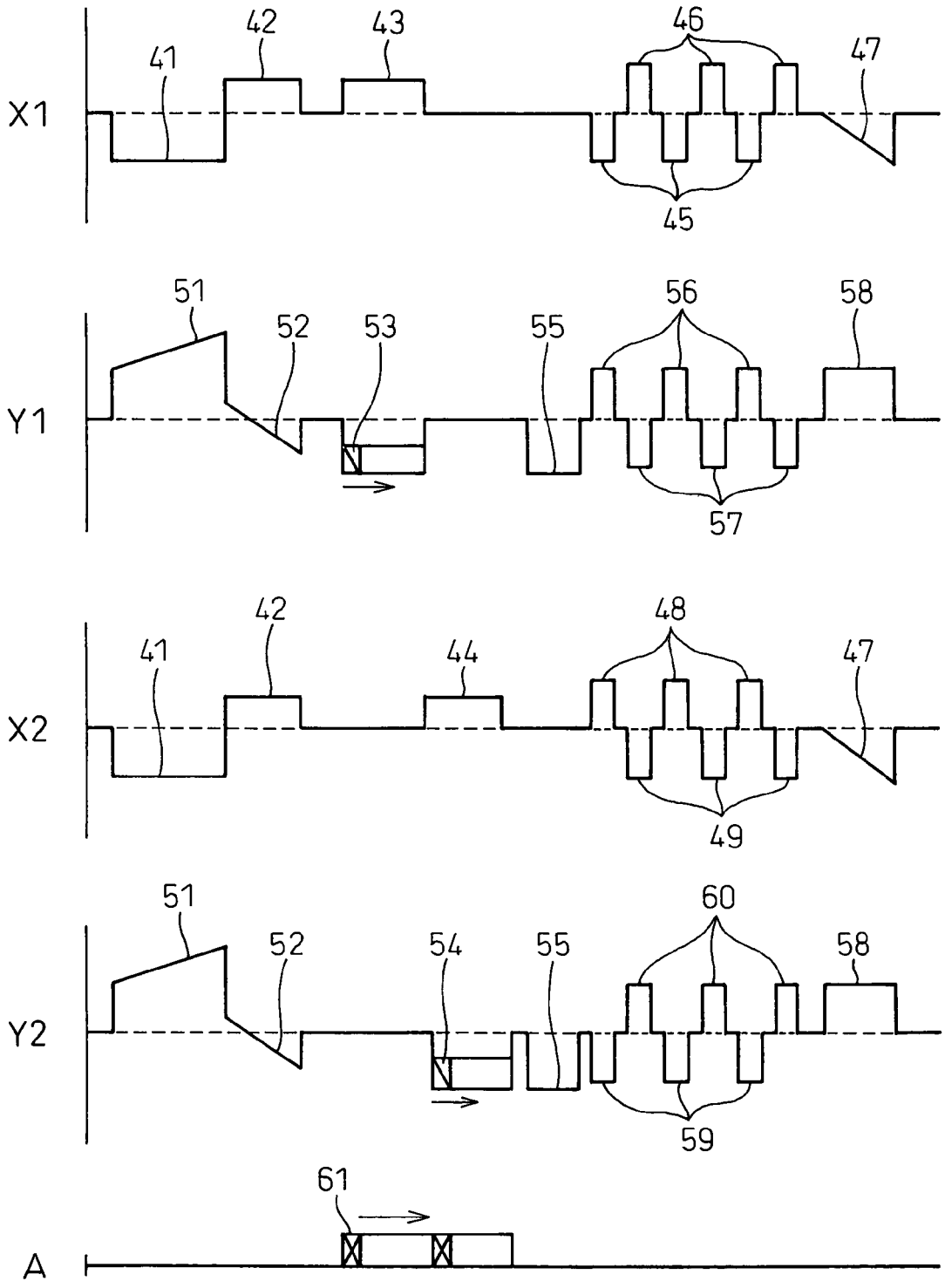
FIG. 7 is a diagram showing drive waveforms (in an odd-numbered field) of the PDP apparatus according to the first embodiment.
Figure 8:
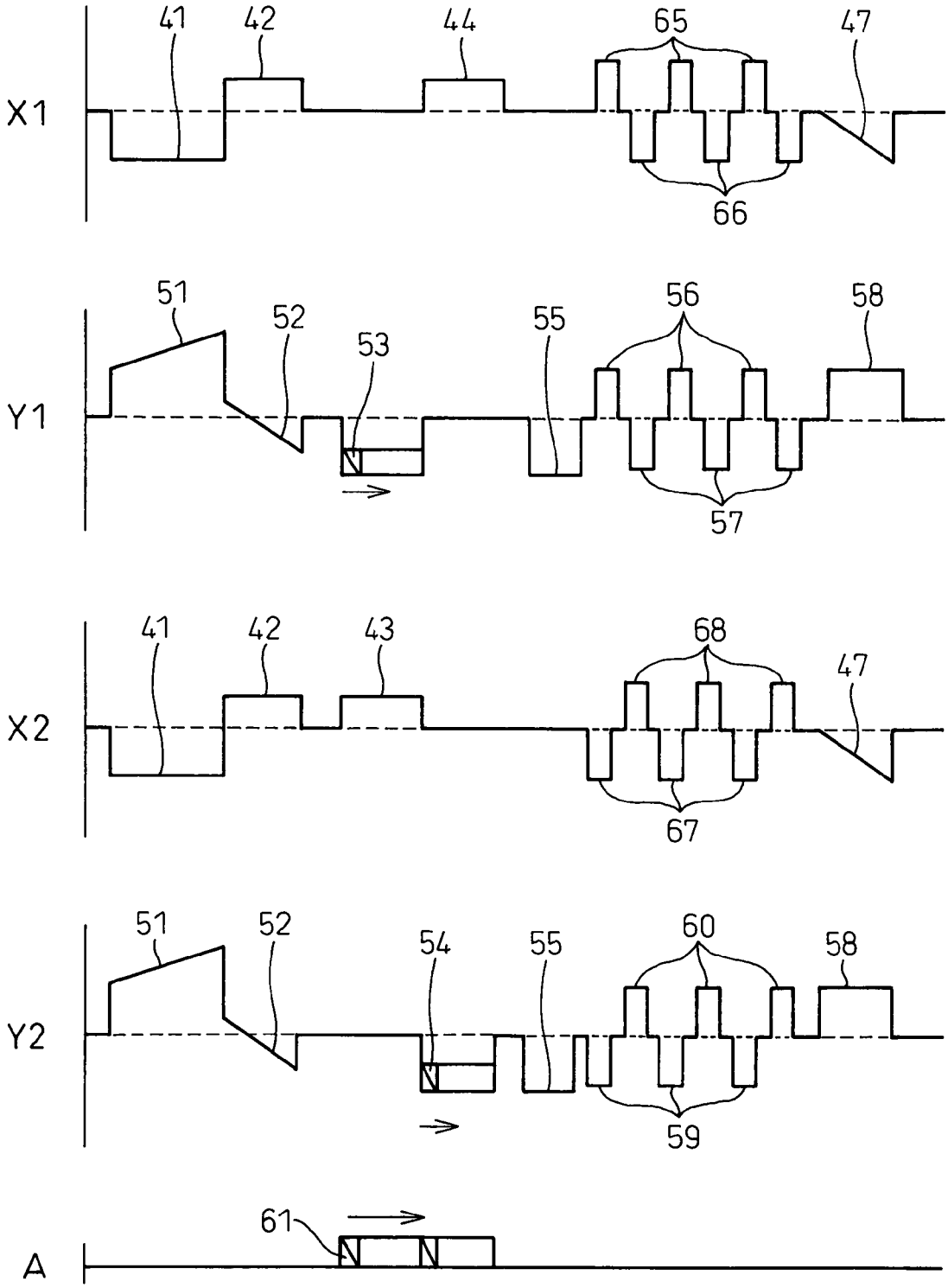
FIG. 8 is a diagram showing drive waveforms (in an even-numbered field) of the PDP apparatus according to the first embodiment.

FIG. 7 and FIG. 8 are diagrams showing drive waveforms in one subfield in the PDP apparatus in the present embodiment. FIG. 7 shows the drive waveforms in the odd number field and FIG. 8 shows the drive waveforms in the even number field, which are applied to an odd-numbered X electrode (X1), an odd-numbered Y electrode (Y1), an even-numbered X electrode (X2), an even-numbered Y electrode (Y2), and an address electrode (A). First, the odd number field is explained below.

The drive waveform to be applied to an X electrode consists of a reset pulse 41 for forming wall charges in each cell by repeatedly causing a weak discharge to occur therein, a compensation voltage 42 for adjusting the amount of residual wall charges, selection pulses 43 and 44 for selecting a display line, sustain pulses 45, 46, 48 and 49, and an erasure pulse 47.

The drive waveform to be applied to a Y electrode consists of a reset obtuse wave 51 for forming wall charges in each cell by repeatedly causing a weak discharge to occur therein, a compensation obtuse wave 52 for adjusting the amount of residual wall charges, scan pulses 53 and 54 to be applied to the Y electrode when a cell to be lit is selected, an adjusting pulse 55 for reversing the polarity of the wall charges in a cell not to be lit by a weak discharge, sustain pulses 56, 57, 59 and 60 for repeatedly causing a sustain discharge to occur, and an erasure pulse 58.

The drive waveform to be applied to an address electrode consists of an address pulse 61.

At the beginning of the reset period, a potential difference is generated between the X discharge electrode 13 and the Y discharge electrode 11 by the reset obtuse wave 51 applied to the Y electrode and the reset pulse 41 applied to the X electrode. Because the reset obtuse pulse 51 whose voltage gradually changes is applied here, a weak discharge and the formation of charges are repeated and wall charges are formed uniformly in each cell. The polarity of the formed wall charges is positive in the vicinity of the X discharge electrode and negative in the vicinity of the Y discharge electrode, and positive charges are also formed in the vicinity of the address discharge electrode. In a conventional panel having a three-electrode type structure, in which address electrodes are formed on the back substrate 2, a high reset voltage is required because the charges on the back substrate are controlled by the voltage to be applied to the electrodes arranged on the front substrate, but in the PDP in the present embodiment, a reset voltage can be reduced because only the charges on the front substrate are controlled.

Next, a voltage having the opposite polarity to that of the wall charges formed by resetting is applied in an obtuse waveform by the compensation obtuse wave 52 applied to the Y electrode and the compensation voltage 42 applied to the X electrode, the amount of wall charges in a cell is reduced by a weak discharge.

The next address period is divided into a first half period and a second half period. During the first half period, in a state in which the selection pulse 43 is applied to the odd-numbered X electrode X1 and 0 V is applied to the even-numbered X electrode X2 and the even-numbered Y electrode Y2, the scan pulse 53 is applied to the odd-numbered Y electrode Y1 while the position of application is changed sequentially. In a state in which a negative voltage is applied to each of the odd-numbered Y electrodes Y1, the negative scan pulse 53 is applied thereto in order to apply a negative pulse having an even larger absolute value while the position of application is changed sequentially. In synchronization with the application of the scan pulse 53, the address pulse 61 is applied to the address discharge electrode. The address pulse 61 is applied when the cell, which corresponds to the intersection of the address electrode and the Y electrode to which the scan pulse has been applied, is to be lit, and is not applied when the cell is not to be lit. At this time, the polarity of the wall charges formed during the reset period is the same as that of the pulse to be applied to each of the Y and address electrodes, and the voltage to be applied can be reduced by the wall charges in question. Due to this, in the cell to which the selection pulse 43, the scan pulse 53 and the address pulse 61 have been applied at the same time, an address discharge is caused to occur. This discharge forms negative wall charges in the vicinity of the X discharge electrode and positive wall charges in the vicinity of the Y discharge electrode. In other words, the cells to be lit are selected in the display line between the odd-numbered X electrode X1 and the odd-numbered Y electrode Y1. As described above, the polarity of the charges formed by the address discharge is opposite to that of the charges formed during the above-mentioned reset discharge. In the vicinity of the even-numbered X discharge electrode to which the selection pulse 43 has not been applied and in the vicinity of the even-numbered Y discharge electrode to which the scan pulse 53 has not been applied, the wall charges at the end of the reset period are maintained.

During the second half period of the address period, in a state in which the selection pulse 44 is applied to the even-numbered X electrode X2 and 0 V is applied to the odd-numbered X electrode X1 and Y electrode Y1, the scan pulse 54 is applied to the even-numbered Y electrode Y2 while the position of application is changed sequentially, and the address pulse 61 is applied to the address electrode. Due to this, the cells to be lit are selected in the display line between the even-numbered X electrode X2 and the even-numbered Y electrode Y2 in the manner similar to that described above. Therefore, an address discharge is caused to occur in the cell to be lit in the odd-numbered display lines during the first half period and the second half period of the address period and as a result, the selection of the cells to be lit has been performed.

At the end of the address period, the charge adjusting pulse 55 having the negative polarity is applied only to the Y electrode. In the cell in which an address discharge has been caused to occur, positive charges have been formed in the vicinity of the Y discharge electrode 11, which will serve so as to reduce the voltage of the charge adjusting pulse, therefore, no discharge is caused to occur. On the other hand, in the cell in which no address discharge has been caused to occur, negative charges have been formed in the vicinity of the Y discharge electrode 11, which will be added to the voltage of the charge adjusting pulse so as to increase the voltage, therefore, a discharge is caused to occur. At this time, no voltage is applied to the X electrode and the address electrode and the potential between the electrodes is small, therefore, the delay of the discharge is large and the intensity is small. Because of this, the charge adjusting pulse needs a period of time longer than or equal to 20 μs and the amount of charges formed after the discharge is small, therefore, no discharge is caused to occur by the subsequent sustain pulse in the cell in which no address discharge has been caused to occur.

During the sustain discharge period, the sustain discharge pulses 45, 46, 59 and 60, in phase, are applied to the odd-numbered X electrode X1 and the even-numbered Y electrode Y2 and the sustain discharge pulses 48, 49, 56 and 57, in phase, are applied to the even-numbered X electrode X2 and the odd-numbered Y electrode Y1. The sustain discharge pulses 45, 46, 59 and 60 have a phase opposite to that of the sustain discharge pulses 48, 49, 56 and 57. Therefore, the voltage of the sustain pulse having a large absolute value is applied between the odd-numbered X electrode X1 and the odd-numbered Y electrode Y1 and between the even-numbered X electrode X2 and the even-numbered Y electrode Y2, and a voltage of the sustain pulse is not applied between the odd-numbered Y electrode Y1 and the even-numbered X electrode X2 and between the even-numbered Y electrode Y2 and the odd-numbered X electrode X1. In other words, the sustain pulse voltage is applied to the odd-numbered display lines and the sustain pulse voltage is not applied to the even-numbered display lines.

At the beginning of the sustain discharge period, the negative sustain discharge pulses 45 and 59 are applied to the odd-numbered X electrode X1 and the even-numbered Y electrode Y2 and the positive sustain discharge pulses 48 and 56 are applied to the even-numbered X electrode X2 and the odd-numbered Y electrode Y1. In the cell in which an address discharge has been caused to occur, negative wall charges are formed in the vicinity of the X discharge electrode and positive wall charges are formed in the vicinity of the Y discharge electrode, and these wall charges will serve so as to increase the potential difference caused by the sustain pulse 45 applied to the odd-numbered X electrode X1 and the sustain pulse 56 applied to the odd-numbered Y electrode Y1, therefore, a sustain discharge is caused to occur between the odd-numbered X electrode X1 and the odd-numbered Y electrode Y1. On the other hand, these wall charges will serve so as to reduce the potential difference caused by the sustain pulse 48 applied to the even-numbered X electrode X2 and the sustain pulse 59 applied to the even-numbered Y electrode Y2, therefore, no sustain discharge is caused to occur between the even-numbered X electrode X2 and the even-numbered Y electrode Y2 by the first sustain pulse. Due to the sustain discharge caused to occur between the odd-numbered X electrode X1 and the odd-numbered Y electrode Y1, the polarities of the wall charges are reversed and positive wall charges are formed in the vicinity of the odd-numbered X discharge electrode X1 and negative wall charges are formed in the vicinity of the odd-numbered Y discharge electrode Y1.

Next, the sustain pulses are reversed and the sustain discharge pulses 46 and 60 having the positive polarity are applied to the odd-numbered X electrode X1 and the even-numbered Y electrode Y2, and the sustain discharge pulses 49 and 57 having the negative polarity are applied to the even-numbered X electrode X2 and the odd-numbered Y electrode Y1. In the cell in which an address discharge has been caused to occur between the even-numbered X electrode X2 and the even-numbered Y electrode Y2, no sustain discharge is caused to occur at first, therefore, the wall charges at the end of the address period have been maintained and, as these wall charges will serve as to increase the potential difference caused by the sustain pulse 49 applied to the even-numbered X electrode X2 and the sustain pulse 60 applied to the even-numbered Y electrode Y2, a sustain discharge is caused to occur between the even-numbered X electrode X2 and the even-numbered Y electrode Y2. Moreover, in the cell in which a sustain discharge has been caused to occur between the odd-numbered X electrode X1 and the odd-numbered Y electrode Y1, negative wall charges are formed in the vicinity of the odd-numbered X discharge electrode X1 and positive wall charges are formed in the vicinity of the odd-numbered Y discharge electrode Y1 and these wall charges serve so as to increase the potential difference caused by the sustain pulse 46 applied to the odd-numbered X electrode X1 and the sustain pulse 57 applied to the odd-numbered Y electrode Y1, therefore, a sustain discharge is caused to occur between the odd-numbered X electrode X1 and the odd-numbered Y electrode Y1. Due to these sustain discharges, the polarities of the wall charges are reversed. Therefore, the sustain discharge is caused to occur repeatedly by applying the sustain pulse repeatedly while reversing the polarities.

The number of the sustain discharge pulses is determined in accordance with the weight of luminance of a subfield and a subfield having a heavier weight of luminance has a longer sustain discharge period.

At the end of the subfield, an erasure discharge is caused to occur in the lit cell in which a sustain discharge has been caused to occur by the erasure pulses 47 and 58 and the amount of the wall charges formed by the sustain discharge is reduced. At this time, in the cell in which no sustain discharge has been caused to occur, no discharge is caused to occur because the amount of wall charges is small.

The drive waveforms and the operations in each subfield in the odd number field are explained as above. As described above, in the odd number field, a display is produced by the lighting of the odd-numbered display lines.

In the even number field, as shown in FIG. 8, the same pulses as those in the odd number field are each applied to each electrode during the reset period. During the first half period of the address period, the selection pulse 43 is applied to the even-numbered X electrode X2 and in a state in which 0 V is applied to the odd-numbered X electrode X1 and the even-numbered Y electrode Y2, the scan pulse 53 is applied to the odd-numbered electrode Y1 while the position of application is changed sequentially. During the second half period of the address period, the selection pulse 43 is applied to the odd-numbered X electrode X1 and in a state in which 0 V is applied to the even-numbered X electrode X2 and the odd-numbered Y electrode Y1, the scan pulse 54 is applied to the even-numbered Y electrode Y2 while the position of application is changed sequentially. Due to this, an address discharge is caused to occur in the cells to be lit in the display lines between the odd-numbered Y electrode Y1 and the even-numbered X electrode X2 and between the even-numbered Y electrode Y2 and the odd-numbered X electrode X1, that is, in the even-numbered display lines, and the cells to be lit are selected.

During the sustain discharge period, sustain discharge pulses 65 and 66 and the sustain discharge pulses 56 and 57, all four of them being in phase, are applied to the odd-numbered X electrode X1 and the odd-numbered Y electrode Y1, and sustain discharge pulses 67 and 68 and the sustain discharge pulses 59 and 60, all four of them being in phase, are applied to the even-numbered X electrode X2 and the even-numbered Y electrode Y2. The sustain discharge pulses 65, 66, 56 and 57 have a phase opposite to that of the sustain discharge pulses 67, 68, 59 and 60. Therefore, the voltage of the sustain pulse having a large absolute value is applied between the odd-numbered Y electrode Y1 and the even-numbered X electrode X2 and between the even-numbered Y electrode Y2 and the odd-numbered X electrode X1. Due to this, a sustain discharge is caused to occur in the even-numbered display lines.

The PDP apparatus according to the first embodiment of the present invention is described as above, but there can be various modifications of the PDP according to the first embodiment and some modifications are explained below.

Figure 9:
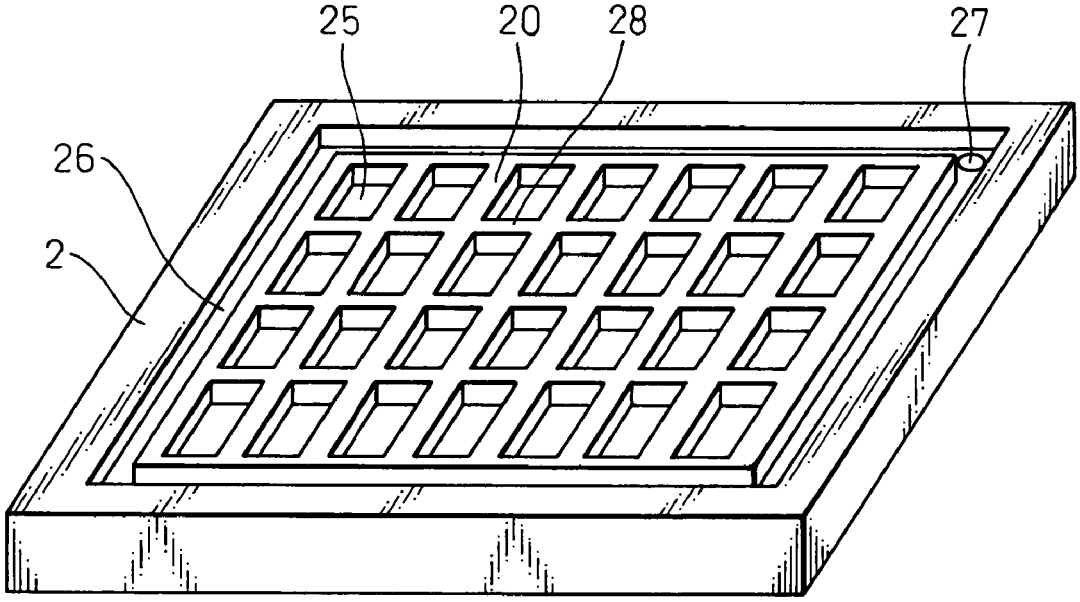
FIG. 9 is a diagram showing an example of a modification of a back substrate.

FIG. 9 is a diagram showing an example of a modification of a back substrate. In the first embodiment, only the longitudinal partitions 20 are provided as a partition, but in this modification, a partition has a two-dimensional grid-shape and consists of longitudinal partitions 20 and transverse partitions 28. The back substrate in this modification is formed by the sand blast method etc., in which the discharge spaces 25 and an exhaust space 26 are engraved directly in the back substrate 2. An exhaust hole 27 penetrates through from the exhaust space 26 to the side of the back substrate 2 and will serve to exhaust air and enclose a discharge gas after the front substrate 1 is bonded to the back substrate, and one or several holes are provided. As the surface of the back substrate 2 almost comes into contact with the surface of the front substrate 1, the height of the seal material 24 is not required to be so great unlike FIG. 3 and FIG. 4 in which the height is great and, therefore, the range of selection of material can be widened. If the width of the intersection of the longitudinal partition and the transverse partition is made greater than that of other parts, a discharge between bus electrodes can be prevented more certainly.

Figure 10:
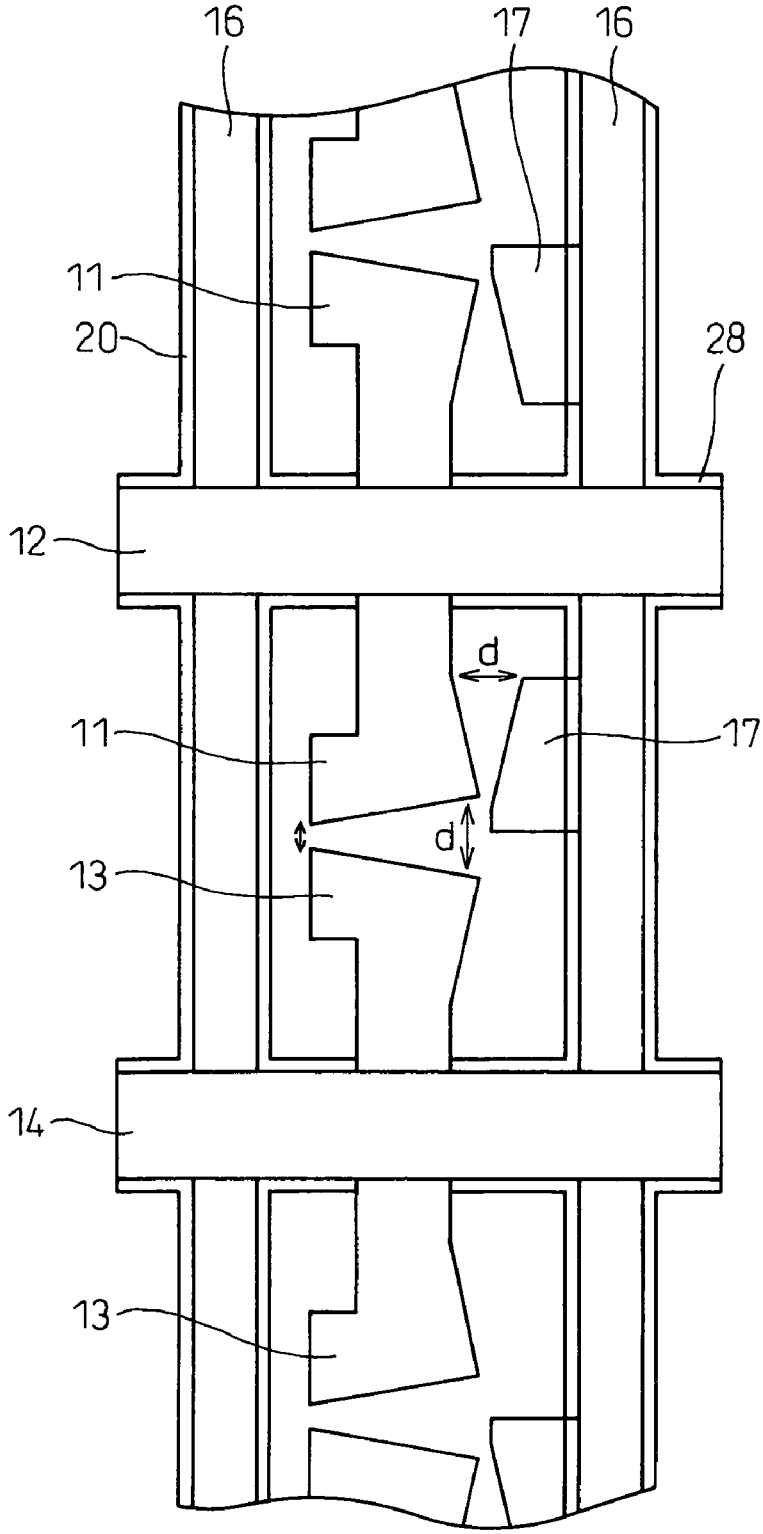
FIG. 10 is a diagram showing an example of a modification using two-dimensional grid-shaped partitions.

FIG. 10 is a diagram showing the relationship between the electrodes and the partition when the back substrate 2 having the two-dimensional grid-shaped partition is used. As shown schematically, the longitudinal partitions 20 are arranged so as to overlap the address bus electrodes 16 and the transverse partitions 28 are arranged so as to overlap the X bus electrodes 14 and the Y bus electrodes 12.

Figure 11:
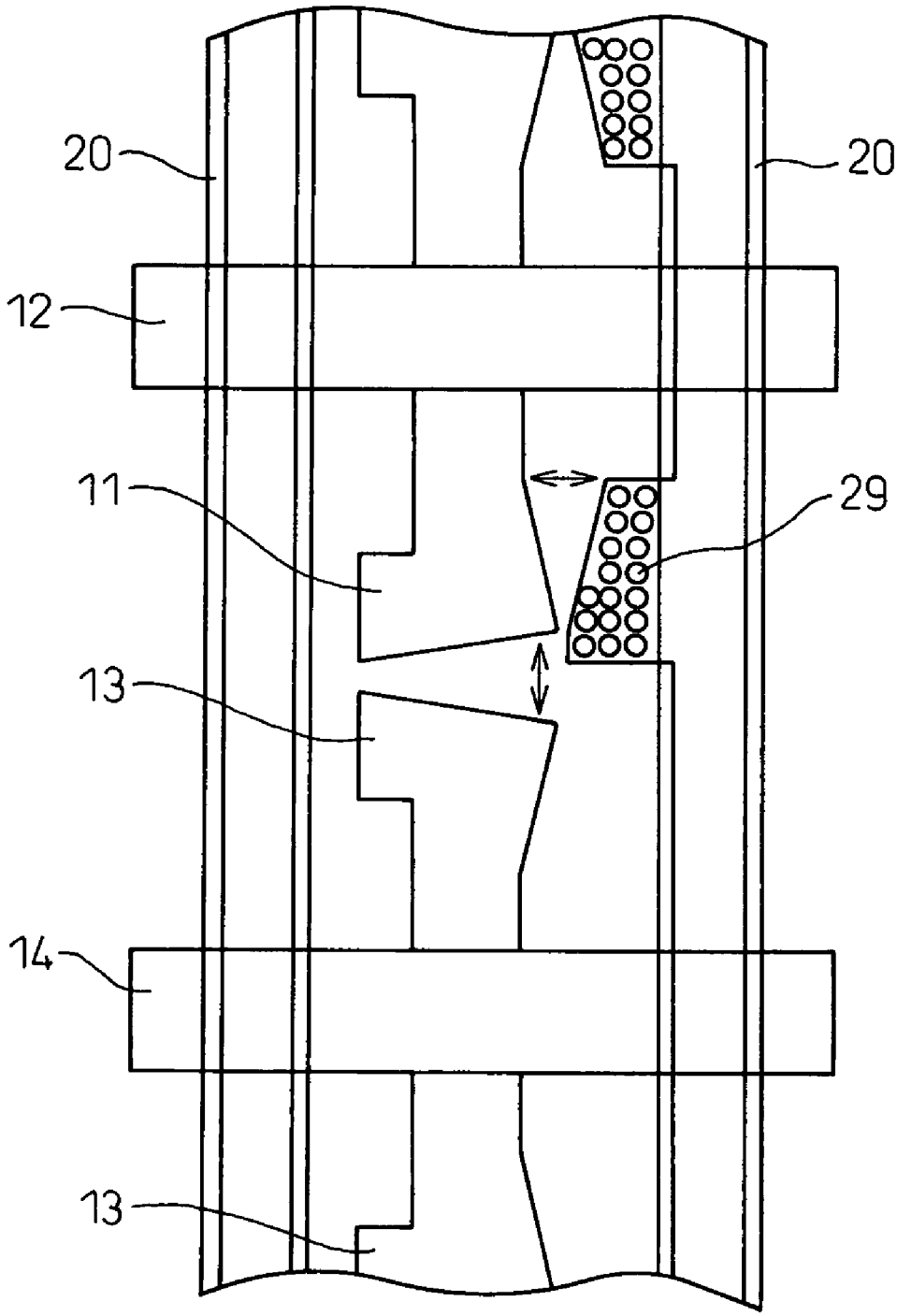
FIG. 11 is a diagram showing an example of a modification of the shape of electrodes.

FIG. 11 is a diagram showing a modification of the address discharge electrode 17. In this modification, the address discharge electrode 17 is formed in the same process as that for forming the address bus electrode 16, and openings 29 that pass light are provided in the address discharge electrode 17 in a mesh-pattern. Therefore, the address discharge electrode 17 is formed by a metal material and does not transmit light. The mesh-patterned openings pass light generated in the phosphor layers. Due to this, the process for forming the address discharge electrode can be eliminated and the manufacturing process can be simplified.

Figure 12:
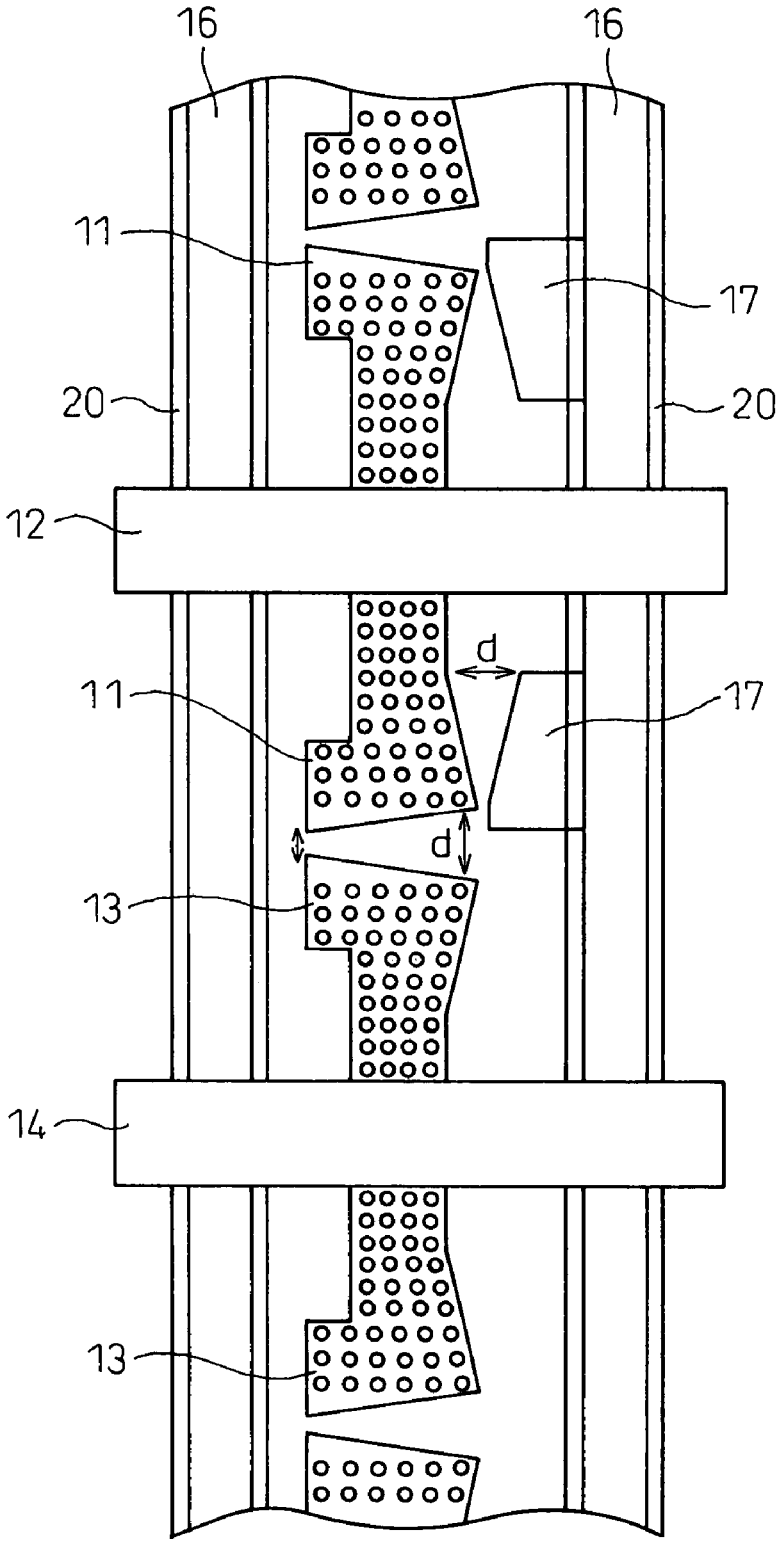
FIG. 12 is a diagram showing another example of a modification of the shape of electrodes.

FIG. 12 is a diagram showing an example of a modification of the X discharge electrode 13 and the Y discharge electrode 11, and like FIG. 11, the X discharge electrode 13 and the Y discharge electrode 11 are formed by the same material as that of the X bus electrode 14 and the Y bus electrode 12, and the provision of mesh-patterned openings make it possible for the light generated in the phosphor layers to be passed.

Figure 13:
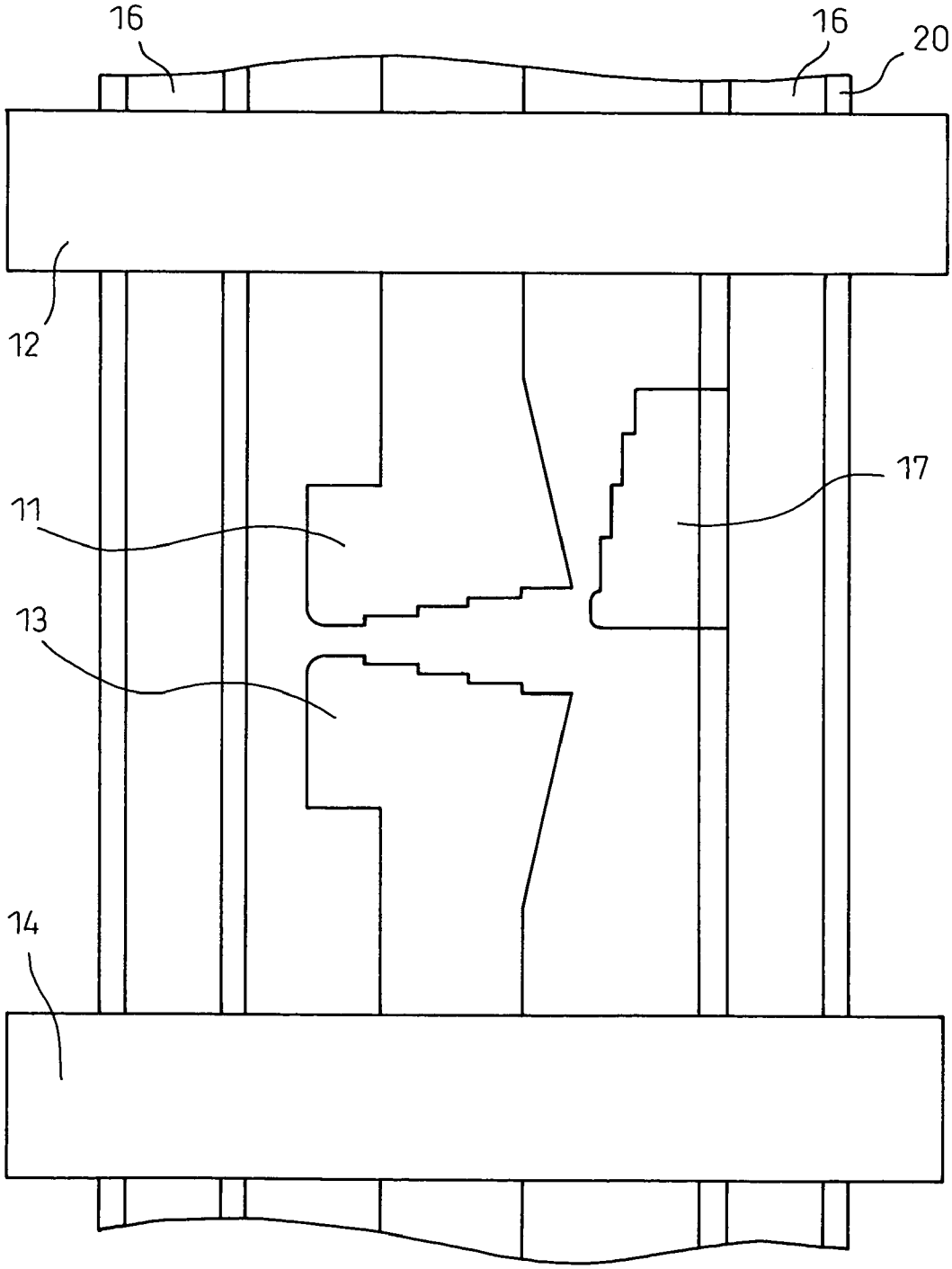
FIG. 13 is a diagram showing another example of a modification of the shape of electrodes.

FIG. 13 is a diagram showing another example of the shapes of the X discharge electrode 13, the Y discharge electrode 11 and the address discharge electrode 17. As shown in FIG. 13, the facing edges of the X discharge electrode 13 and the Y discharge electrode 11 are each formed stepwise and the distance between the X discharge electrode 13 and the Y discharge electrode 11 changes stepwise. As for the facing edges of the Y discharge electrode 11 and the address electrode 17, the edge of the Y discharge electrode 11 is linear but the edge of the address discharge electrode 17 is stepwise, therefore, the distance between the facing edges changes stepwise and changes linearly in each step. Even from these shapes of the discharge electrodes, the same effect as that in the first embodiment can be obtained. In a structure in which electrodes have a plurality of protrusions and a plurality of pairs of facing protrusions are provided, and the distance between each pair is changed, a discharge under the Paschen condition is caused to occur but the discharge that satisfies this condition does not propagate, therefore, a sufficient effect cannot be obtained.

In the first embodiment, the present invention is applied to an ALIS system PDP apparatus, but the present invention can also be applied to a three-electrode type PDP apparatus not employing the ALIS system. In the second embodiment of the present invention, the present invention is applied to a three-electrode type PDP apparatus not employing the ALIS system.

Figure 14:
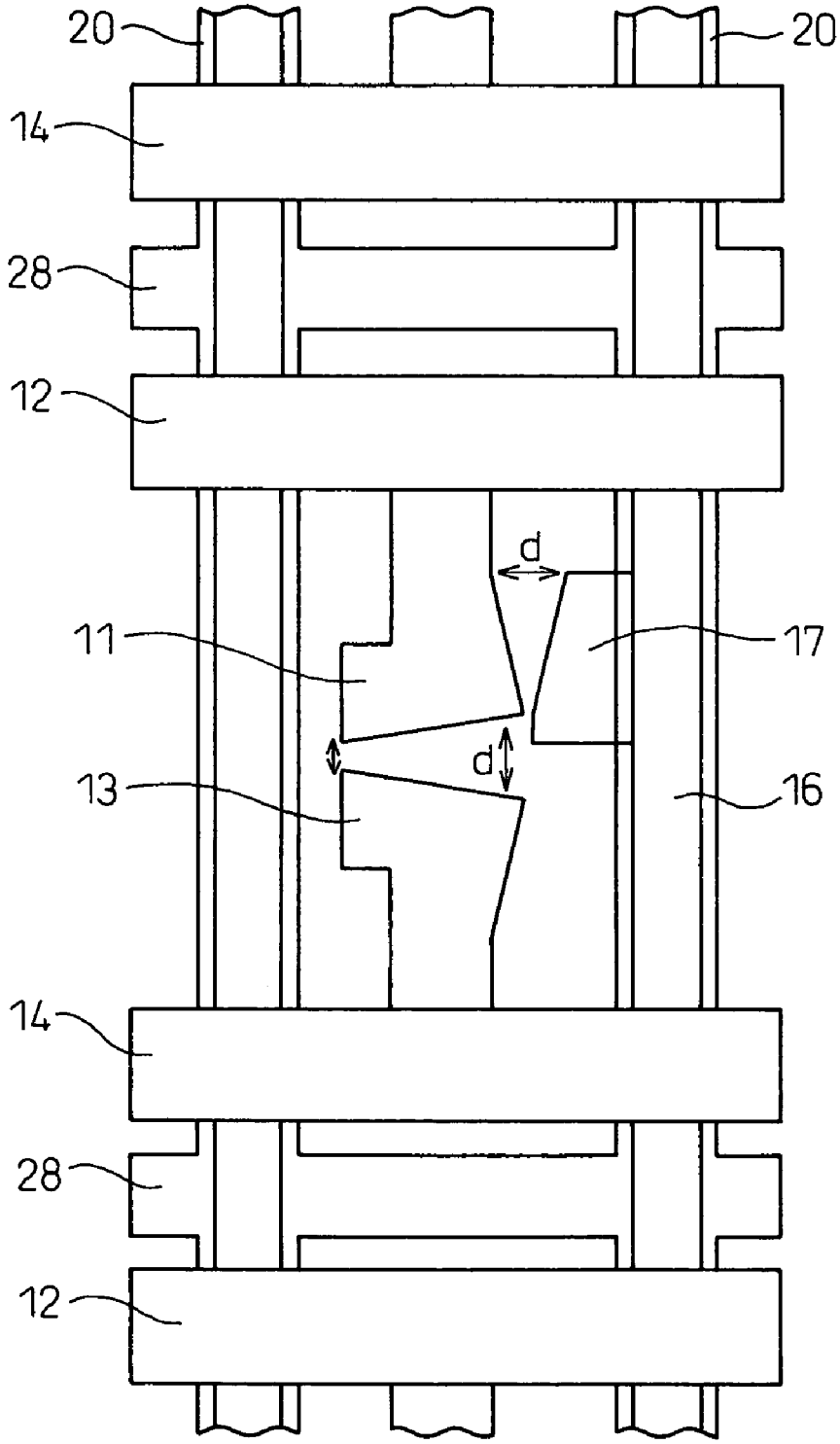
FIG. 14 is a diagram showing the shape of electrodes according to a second embodiment of the present invention.

FIG. 14 is a partly top plan view showing a structure and electrode shapes in a cell in the plasma display panel of the PDP apparatus according to the second embodiment of the present invention. The positional relationship between electrodes and the method for forming electrodes in the second embodiment are the same as those in the first embodiment and, therefore, only the differences are explained here. As shown schematically, the Y bus electrodes 12 and the X bus electrodes 14 are arranged, in turn, in parallel to each other and the Y discharge electrode 11 protrudes from one side of the Y bus electrode 12 and the X discharge electrode 13 protrudes from the side facing the Y discharge electrode 11 of the X bus electrode 14. The address discharge electrode 17 protrudes from the address bus electrode 16. The longitudinal partitions 20 are provided so as to overlap the address bus electrodes 16. The transverse partitions 28 are provided between the Y bus electrode 12 and the X bus electrode 14, where the Y discharge electrode 11 and the X discharge electrode 13 do not protrude. The longitudinal partitions 20 and the transverse partitions 28 make up a two-dimensional grid. Like the first embodiment, the distance between the facing edges of the Y discharge electrode 11 and the X discharge electrode 13 changes and the distance between the facing edges of the Y discharge electrode 11 and the address discharge electrode 17 also changes. There can be modifications of the shapes of electrodes in the second embodiment like the first embodiment.

Figure 15:
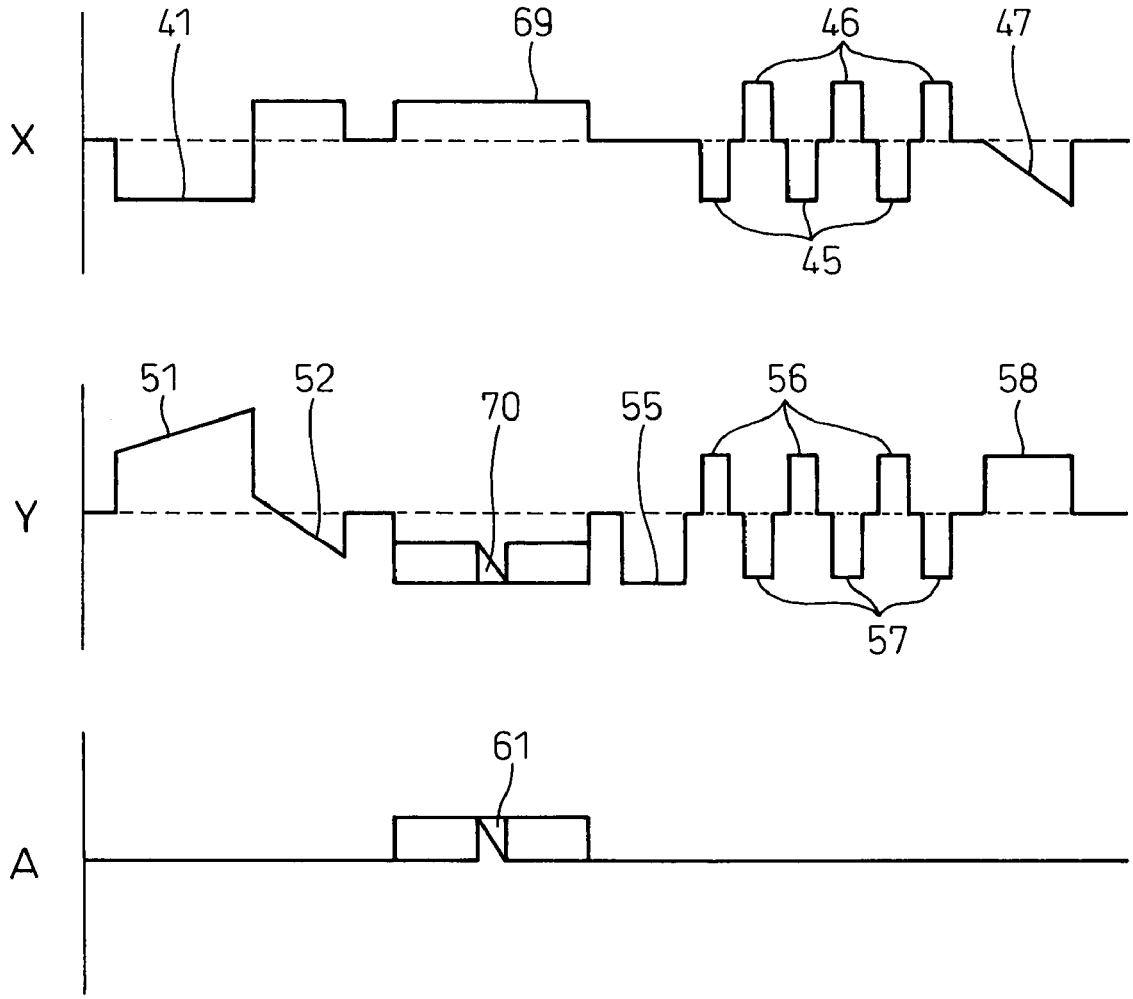
FIG. 15 is a diagram showing drive waveforms according to the second embodiment.

The PDP apparatus according to the second embodiment uses a plasma display panel having the structure and the electrode shapes shown in FIG. 14. The drive circuit and the drive waveforms can be realized by the prior art. For reference, the drive waveforms in the second embodiment are shown in FIG. 15.

According to practical conditions of the present plasma display panel, a distance corresponding to the Paschen minimum becomes near to or less than a minimum distance which causes no short-circuit under the present production technique. As described above, since the second discharge electrode and the third discharge electrode are provided via the dielectric layer, they do not short-circuit even if the distance becomes very small, for example, zero (that is, parts of them overlap each other). However, when the distance between the facing edges of the X discharge electrode and the Y discharge electrode is narrow, it becomes apparent that a short-circuit occurs between the first discharge electrode and the second discharge electrode because first discharge electrode and the second discharge electrode are formed on a same surface.

When the short-circuit occurs between the first and second discharge electrodes, the plasma display panel become defective and a production yield of the panel is decreased. This increases a production cost of the panel. This problem will be solved by an advance of the production technique. However, it is not easy to produce a plasma display panel of the first and second embodiments with a sufficient low cost under the present production technique. A plasma display panel of a third embodiment can be produced without decrease of production yield under the present production technique.

Figure 16:
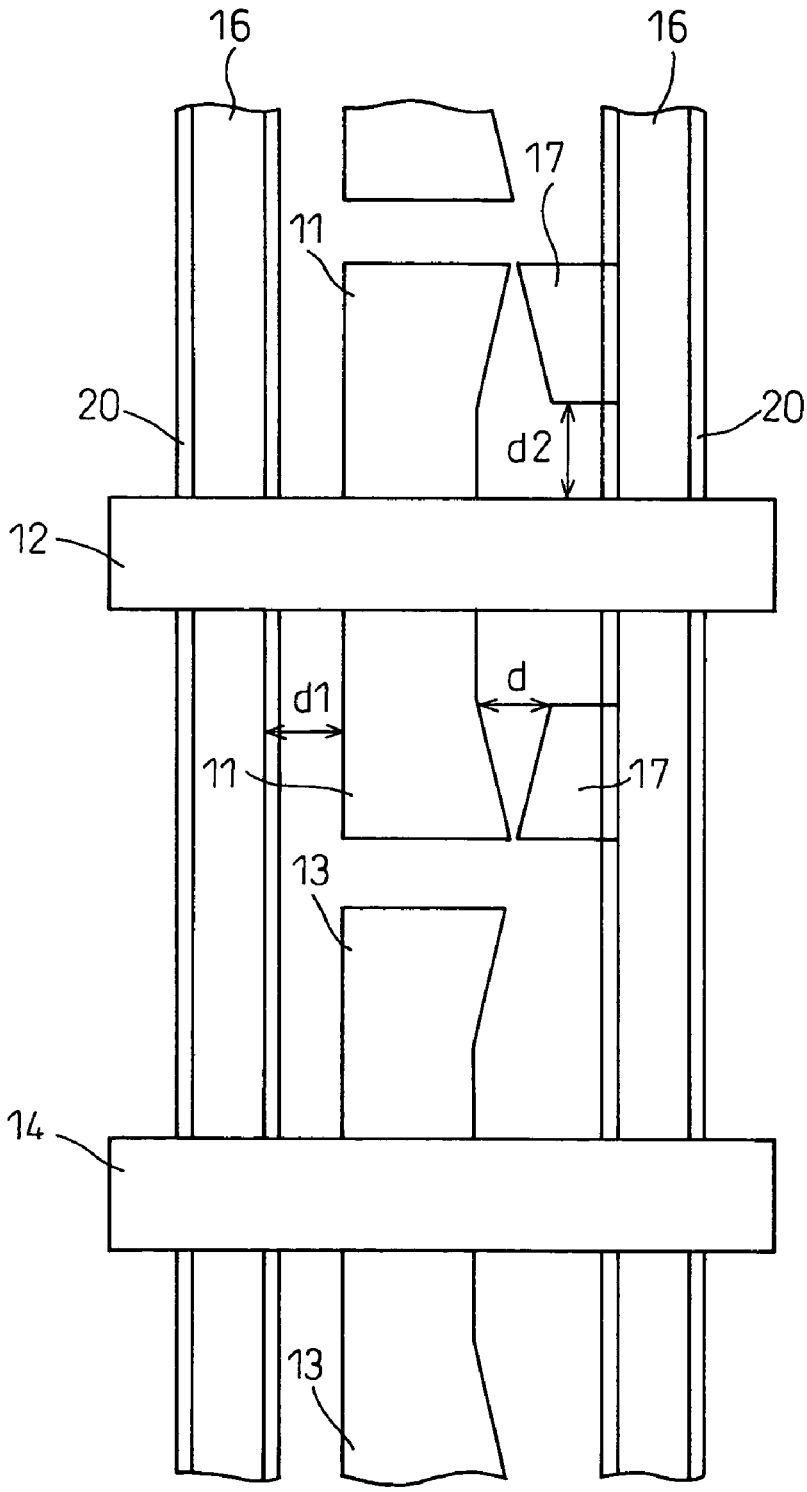
FIG. 16 is a diagram showing the shape of electrodes according to a third embodiment of the present invention.

FIG. 16 is a part top plan view showing the structure of a cell and the shape of electrodes according to the third embodiment. By comparing the shapes of the electrodes of FIG. 16 with those of FIG. 5, it is apparent that the shapes of the electrodes of the third embodiment is different from those of the first embodiment in that the facing edges of the Y discharge electrode 11 and the X discharge electrode 13 are parallel and the distance between the facing edges is constant. Further, in order to repeat discharges between the two electrodes, the first discharge electrode and the second discharge electrode substantially have a same figure and a same area and are substantially symmetric. In this embodiment, the distance between the facing edges of the Y discharge electrode 11 and the X discharge electrode 13 is, for example, 50 μm. The distance between the Y and X discharge electrodes is determined by considering various conditions such as the pressure of a discharge gas, production size tolerance, and so forth. The above value is only an example.

In the third embodiment, since the distance between the facing edges of the Y discharge electrode 11 and the X discharge electrode 13 is constant and it is comparatively large, no short-circuit occurs even if the positions and sizes of the Y and X discharge electrodes vary due to the production errors. Therefore, a production yield does not decrease.

Further, since the facing edges of the Y discharge electrode 11 and the address discharge electrode 17 are formed to gradually change a distance, a position at which the Paschen minimum condition is satisfied always exists. Therefore, the address discharge start voltage can be reduced in a same way as the first embodiment.

Further, the distance d between the facing edges of the Y discharge electrode 11 and the address discharge electrode 17 is narrower at a side nearer to the X discharge electrode 13. As described in the first embodiment, according to this shapes of the electrodes, the discharge between the Y discharge electrode 11 and the address discharge electrode 17 easily induces a discharge between the X discharge electrode 13 and the Y discharge electrode 11.

The distance d1 between the Y discharge electrode 11 and the address bus electrode of a neighboring column is wider than the maximum distance between facing edges of the Y discharge electrode 11 and the address discharge electrode 17. According to this constitution, an erroneous discharge between the Y discharge electrode 11 and the address discharge bus electrode 16 of the neighboring column can be avoided.

The distance d2 between the address discharge electrode 17 and the Y bus electrode 12 is wider than the maximum distance between facing edges of the Y discharge electrode 11 and the address discharge electrode 17. According to this constitution, an erroneous discharge between the address discharge electrode 17 and the Y bus electrode 12 can be avoided. As described above, the discharge between the Y electrode (including the Y discharge electrode 11 and the Y bus electrode 12) and the address discharge electrode 17 is desirable to occur at a position near to the X discharge electrode 13.

The other portions of the third embodiment are same as those of the first embodiment. Further, the modifications of the first embodiment can be also applied to the third embodiment. The further detailed descriptions regarding the third embodiment are omitted.

The third embodiment can also have various modifications. In the following, the modifications of the third embodiment are described.

In a color plasma display panel, phospher layers of red, green and blue are sequentially provided at every column. As described above, the phospher layers are coated on the sides and bottom of the partitions (rib) 20. The phospher layers respectively have different coating characteristics, then, distances from the protective layer 19 at a surface of the first substrate to the surfaces of the respective phospher layers are different. The differences of the distances influence the discharge characteristics. Particularly, since the address discharge electrode 17 is arranged at a position near to the rib 20, the differences of the distances influence to the discharge characteristic between the Y discharge electrode 11 and the address discharge electrode 17. When the discharge characteristic between the Y discharge electrode 11 and the address discharge electrode 17 is different, the Paschen curve also changes.

In the third embodiment, the distance between the Y discharge electrode 11 and the address discharge electrode 17 changes so that the Paschen minimum condition certainly exists within a changing scope of the distance. However, when the Paschen curve is changed in each color, the distance between the electrodes should be also changed.

Figure 17:
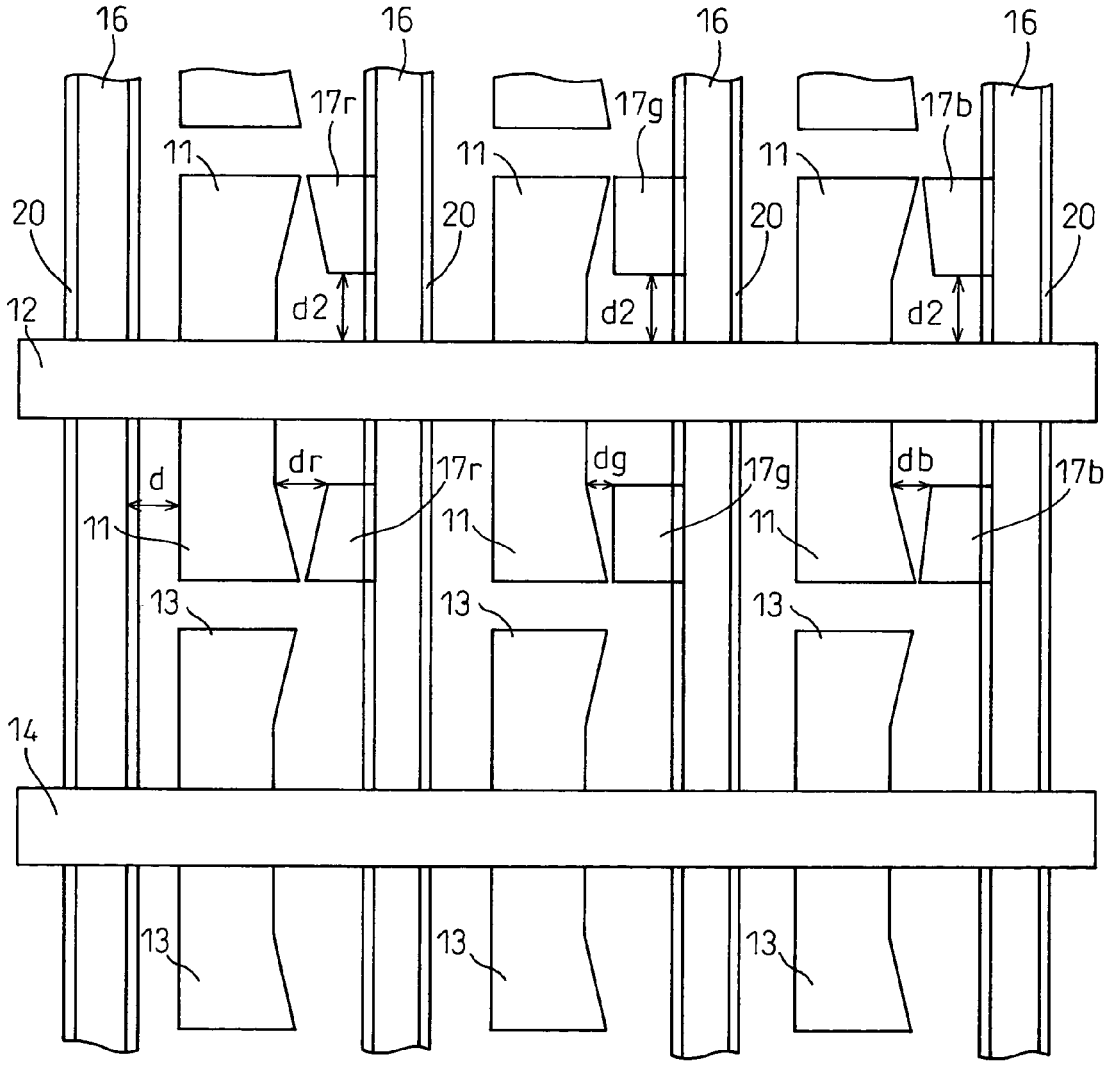
FIG. 17 is a diagram showing another example of a modification of the shape of electrodes.

FIG. 17 shows a modification in which the distances between the Y discharge electrode 11 and the address discharge electrode 17 change in different forms for respective colors R, G and B, and the changing scopes of the distances are set to optimum for the respective colors. The shapes of electrodes shown in FIG. 17 have same shapes as those of FIG. 16 except that the shapes of the address discharge electrodes 17*r*, 17*g*, 17*b* are different for respective colors. The address discharge electrode 17*r* of a red cell has a shape that a distance between the address discharge electrode 17*r* and the Y discharge electrode 11 changes from zero to dr, the address discharge electrode 17*g* of a green cell has a shape that a distance between the address discharge electrode 17*g* and the Y discharge electrode 11 changes from zero to dg, and the address discharge electrode 17*b* of a blue cell has a shape that a distance between the address discharge electrode 17*b* and the Y discharge electrode 11 changes from zero to db. The example shown in FIG. 17 has shapes of dr>db>dg.

In the modification shown in FIG. 17, the minimum distances between the Y discharge electrodes 11 and the address discharge electrodes 17*r*, 17*g*, 17*b* are equally zero in all color cells and the maximum distances between the Y discharge electrodes 11 and the address discharge electrodes 17*r*, 17*g*, 17*b* are respectively different. However, for example, both of the minimum and maximum distances can be different.

Figure 18:
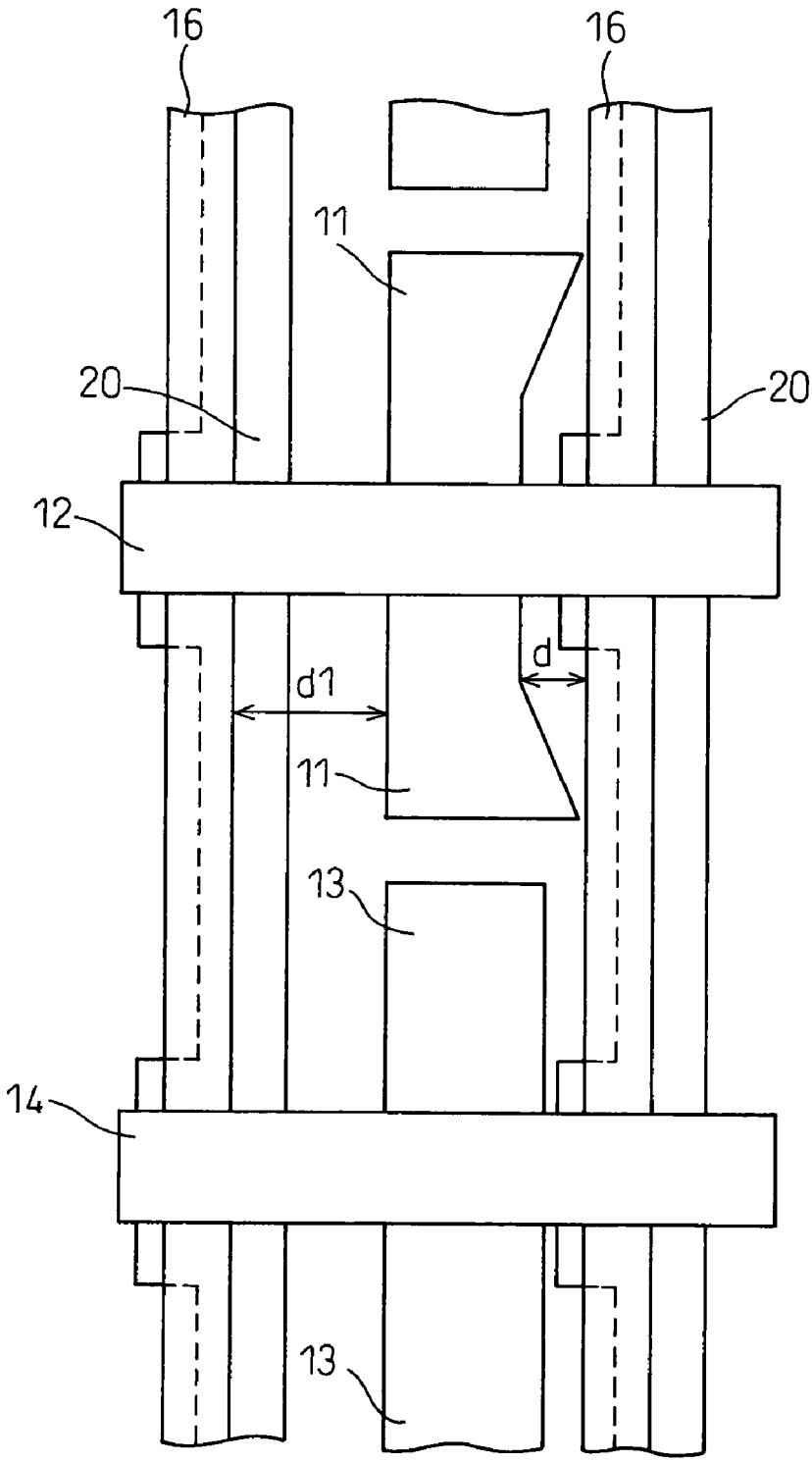
FIG. 18 is a diagram showing another example of a modification of the shape of electrodes.

FIG. 18 shows an another modification of shapes of the electrodes. In this modification, the X discharge electrode 13 has an edge which is parallel to an edge of the Y discharge electrode 11, but the shape of the X discharge electrode 13 is rectangular and is different from that of the Y discharge electrode 11. Further, the address discharge electrode 17 which is provided in the third embodiment is omitted. A discharge is occurred between the Y discharge electrode 11 and the address bus electrode 16. As shown in the figure, each partition (rib) 20 is arranged to overlap a half of right side of the address bus electrode 16 and is widened to overlap the full width of the address bus electrode at positions at which the address bus electrode 16 intersects the Y bus electrode 12 and the X bus electrode 14. The Y discharge electrode 11 has a shape similar to that of FIG. 16, and the distance between the Y discharge electrode 11 and the address bus electrode 16 changes from zero to d. In the portion in which the distance between the Y discharge electrode 11 and the address bus electrode 16 changes from zero to d, the address bus electrode 16 does not overlap the partition (rib) 20, therefore, a discharge can be occurred at such portion. In the same way as the first embodiment, since the distance between the Y discharge electrode 11 and the address bus electrode 16 changes from zero to d, the distance corresponding to the Paschen minimum always exists.

The near edge of the address bus 16 of a neighboring column is overlapped with the partition (rib) 20 and the distance d1 between the near edge and the Y discharge electrode 11 is larger than the maximum distance d between the Y discharge electrode 11 and the address bus electrode 16. Therefore, no discharge occurs between the Y discharge electrode 11 and the address bus 16 of the neighboring column.

Further, the address discharge electrode 17 can be made of a metal layer which is simultaneously produced when the address bus electrode 16 is produced. In this case, the protrusion of the address discharge electrode 17 from the address bus electrode 16 should be smaller so that the facing edges of the Y discharge electrode 11 and the address discharge electrode 17 become nearer to the partition (rib) 20. By this, the decrease of light can be smaller although the address discharge electrode 17 is made of the opaque metal layer.

Figure 19:
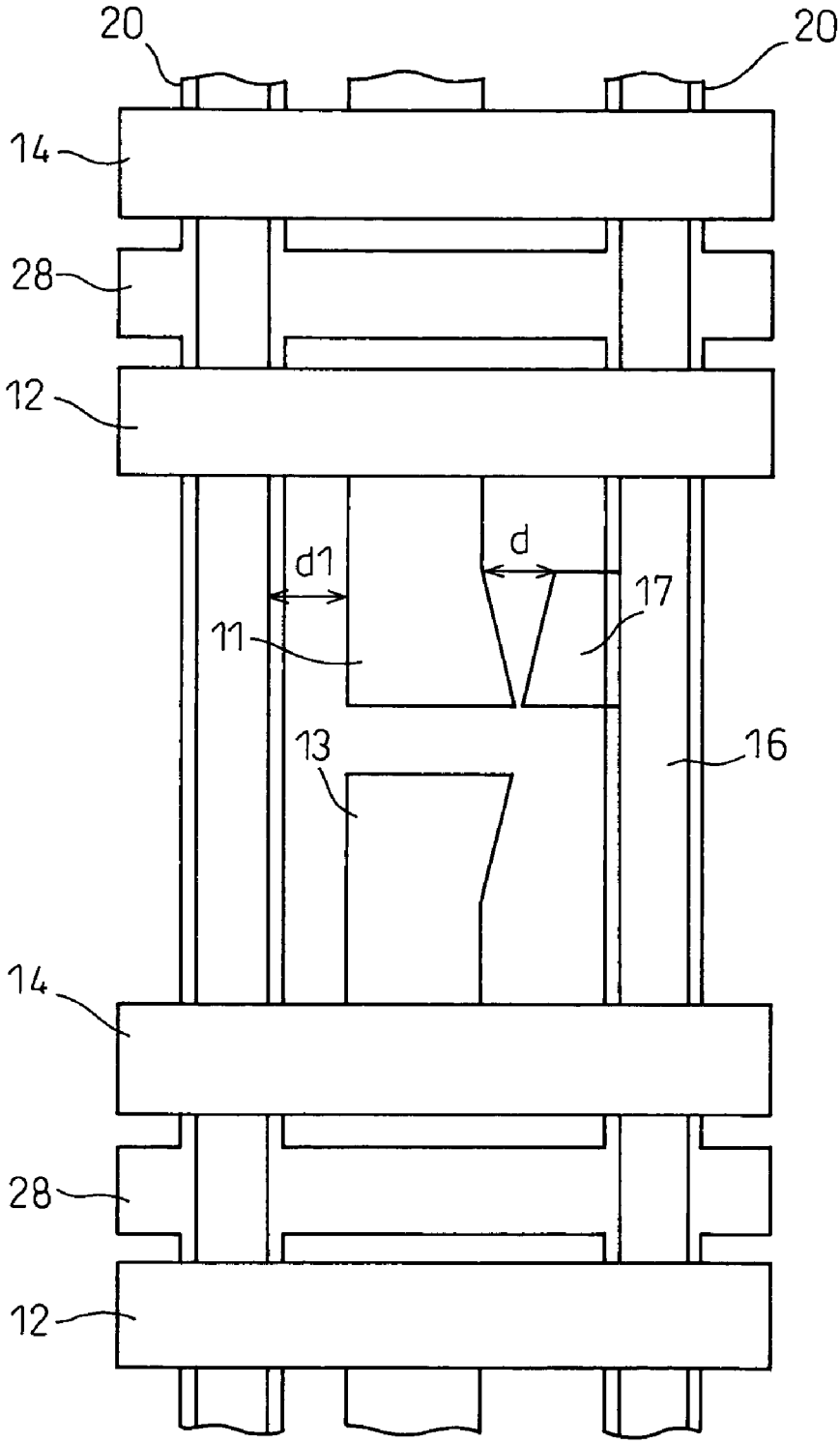
FIG. 19 is a diagram showing the shape of electrodes according to a fourth embodiment of the present invention.

FIG. 19 is a part top plan view showing the structure of a cell and the shape of electrodes according to the fourth embodiment. The fourth embodiment is an example in which the shapes of electrodes of the third embodiment are applied to the normal plasma display panel of three electrode type of the second embodiment which is not an ALIS type plasma display panel. The constitution and feature of the fourth embodiment are same as those of the second and third embodiments. Therefore, a detailed description of the fourth embodiment is omitted.

In the first to fourth embodiments, all of the first (X) electrodes, the second (Y) electrodes and the third (address) electrodes are provided on the transparent first (front) substrate. This offers an advantage that the drive voltage between the Y electrode and the address electrode can also be reduced but, on the other hand, if two layers of electrodes are arranged on one of the substrates, the thickness of the dielectric layer that covers them is increased, the difference between the shape of the electric field formed on the surface of the dielectric and the shape of the original electrode is made bigger, and an highly accurate control of the distances will become very difficult. In contrast to this, a conventional three-electrode type PDP apparatus widely used has a structure in which X and Y electrodes are provided on a transparent front substrate and address electrodes are provided on a back substrate, and the thickness of the dielectric layer on each electrode can be reduce although the drive voltage between the Y electrode and the address electrode cannot be reduced, therefore the above-problem is not brought about. In the next fifth embodiment, the present invention is applied to a conventional three-electrode type PDP apparatus widely used, in which address electrodes are provided on a back substrate.

The fifth embodiment of the present invention is an ALIS system PDP apparatus having the same structure as that in the first embodiment shown in FIG. 1, and differs from the first embodiment in the structure of the panel.

Figure 20:
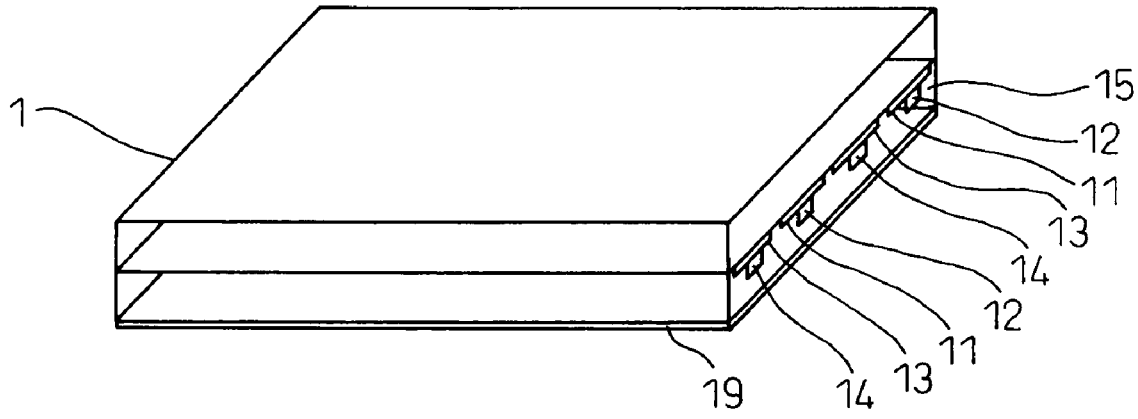
FIG. 20 is an exploded perspective view of a PDP according to a fifth embodiment.
Figure 20:
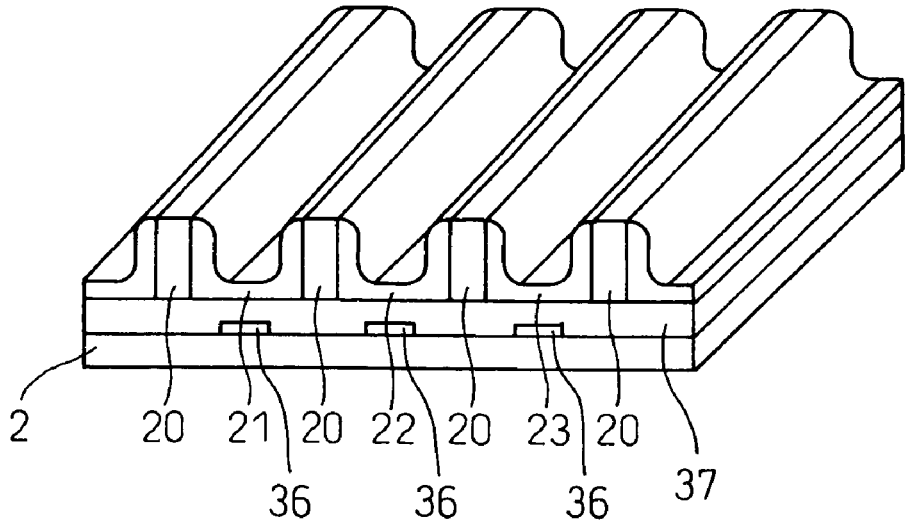

FIG. 20 is an exploded perspective view of a plasma display panel (PDP) according to the fifth embodiment. As shown schematically, on the front (first) glass substrate 1, the first (X) bus electrodes 14 and the second (Y) bus electrodes 12 extending in the transverse direction are arranged by turns in parallel to each other and the X and Y discharge electrodes 13 and 11 are provided so as to overlap the bus electrodes. On the discharge electrodes 13 and 11 and the bus electrodes 14 and 12, the first dielectric layer 15 is provided so as to cover these electrodes. The first dielectric layer 15 is composed of $SiO_2$ etc., formed by the vapor phase film deposition method. The thickness of the first dielectric layer is approximately less than or equal to 10 μm. The protective layer 19 such as MgO is further formed thereon.

On the back substrate 2, on the other hand, the third (address) electrodes 36, which are metal layers, are provided so as to perpendicularly intersect the X and Y bus electrodes 14 and 12. The dielectric layer 37 composed of $SiO_2$ etc., formed by the vapor phase film deposition method is formed so as to cover the address electrodes 36. The longitudinal partitions 20 are formed thereon so as to be located between the address electrodes 36, and the sides and bottom of the groove formed by the longitudinal partitions 20 and the dielectric layer 37 are coated with the phosphor layers 21, 22 and 23 that are excited by the ultraviolet rays generated during a discharge and generate red, green and blue visible light. The front substrate 1 and the back substrate 2 are bonded to each other with a seal and a discharge gas composed of Ne, Xe, He, etc., is enclosed in the discharge space surrounded by the partitions 20. It is desirable that the mixing ratio of xenon in the discharge gas is more than or equal to 10% and the gas pressure is approximately 50,000 to 70,000 Pa.

As described above, the PDP according to the fifth embodiment differs from the PDP according to the first embodiment in that the third (address) electrodes 27 are provided on the back (second) substrate and other configurations are similar and, therefore, no explanation is given here.

Figure 21:
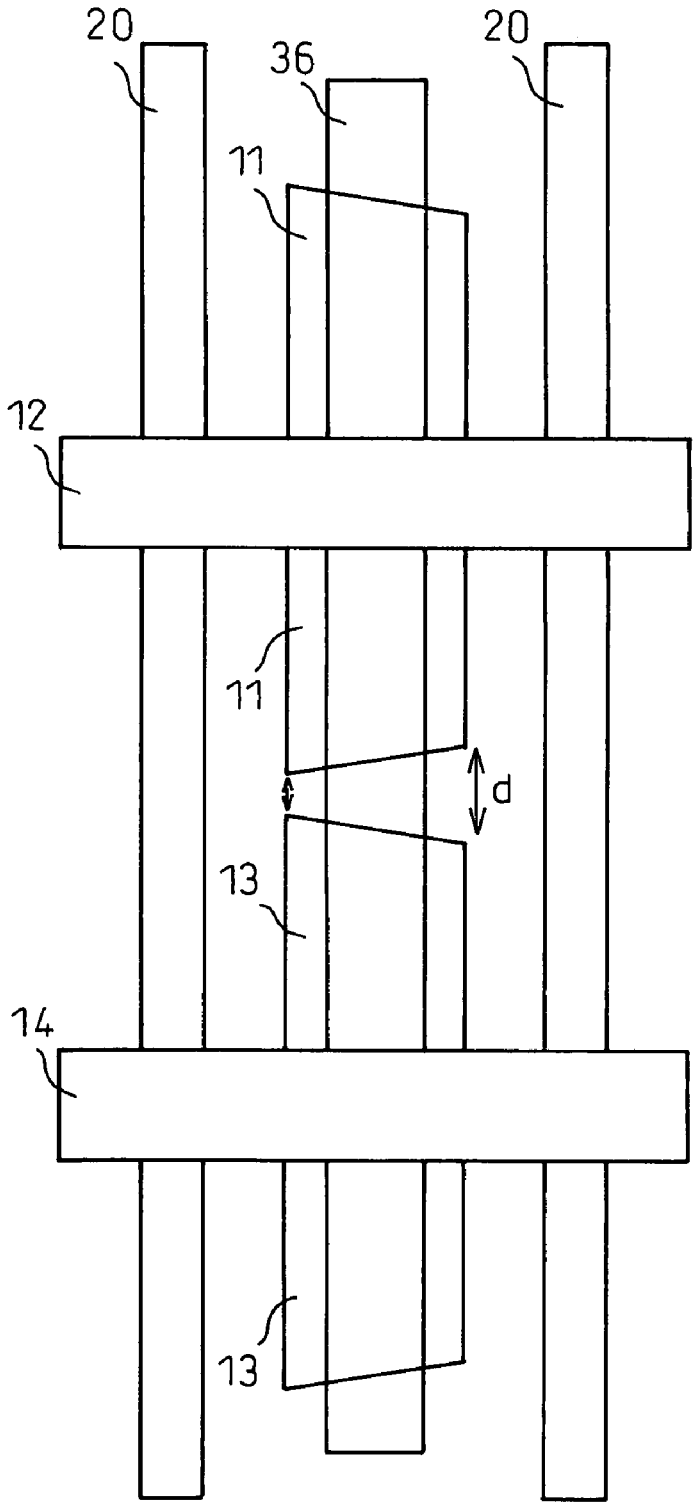
FIG. 21 is a diagram showing the shape of electrodes according to the fifth embodiment.

FIG. 21 is a part top plan view showing the structure and the shapes of the electrodes of a cell in the fifth embodiment. As shown schematically, the Y bus electrodes 12 and the X bus electrodes 14 are arranged by turns in parallel to each other and the light-transmitting Y discharge electrode and X discharge electrode 13 protrude from both sides of each bus electrode, respectively. The Y discharge electrode 11 and the X discharge electrode 13 protruding so as to face each other are formed so that the distance between the facing edges changes gradually, as shown schematically. The distance d between electrodes is, for example, approximately 20 μm at the ends where the two edges are closest and, approximately 100 μm, or preferably, 50 μm at the other ends. The facing edges of the electrodes 11 and 13 are approximately 100 μm in length, therefore, the angle formed by the facing edges is much less than 90°, and preferably, approximately 20°. The distance d between electrodes is determined based on the relationship with the pressure of the enclosed discharge gas according to the Paschen's law, as described in the first embodiment. Moreover, as described in the first embodiment, the facing edges may be stepwise edges and curved edges instead of linear edges as long as the distance between electrodes changes.

The address electrodes 16 extending in the direction substantially perpendicular to the X and Y bus electrodes 14 and 12 are arranged so as to overlap the Y discharge electrodes 11 and the X discharge electrodes 13 when viewed from a direction perpendicular to the substrates 1 and 2. Consequently, the partitions 20 are arranged between the respective Y discharge electrodes 11 and the respective X discharge electrodes located adjacently in the transverse direction, defining the cells.

In the fifth embodiment, as described above, a discharge between the Y discharge electrode 11 and the X discharge electrode 13 can be set to the Paschen minimum state, but a discharge between the Y discharge electrode 11 and the address electrode 16 remains the same as before. In a three-electrode type PDP apparatus, however, the power consumed by the discharge between the Y discharge electrode 11 and the X discharge electrode 13 is large, therefore, if the discharge between the Y discharge electrode 11 and the X discharge electrode 13 can be set to the Paschen minimum state, a considerable effect can be obtained.

Figure 22:
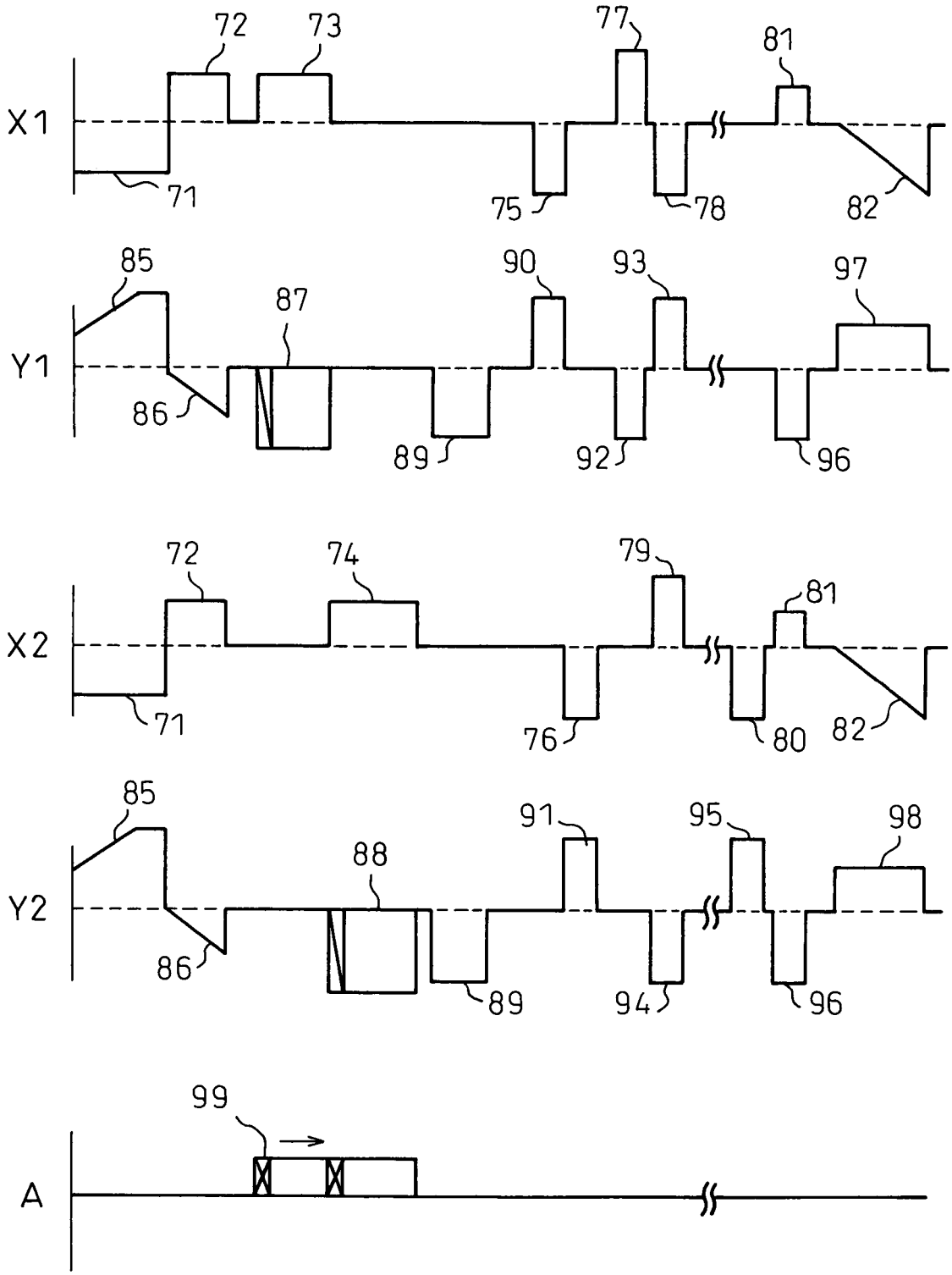
FIG. 22 is a diagram showing drive waveforms (in an odd-numbered field) in the PDP apparatus according to the fifth embodiment.

FIG. 22 is a diagram showing the drive waveforms in one odd number subfield in the PDP apparatus according to the fifth embodiment. As the drive waveforms in FIG. 18 are similar to the drive waveforms in the first embodiment in FIG. 7, only the differences are explained below.

In the fifth embodiment, the discharge start voltage between the X electrode and the Y electrode is reduced, but the discharge voltage between the address electrode and the Y electrode remains the same as before, therefore, it is necessary to make an address discharge more likely to occur. The address discharge is made more likely to occur by making the final potential of a compensation obtuse wave 86, for adjusting the amount of residual wall charges during the reset period, higher than that in the first embodiment to make large the amount of residual wall charges at the end of the reset period. In the first embodiment, the potential of scan pulses 87 and 88 is the same as that of negative sustain pulses 92 and 94 to be applied to the Y electrode, but in the third embodiment, the potential of the scan pulses 87 and 88 are made lower than that of the negative sustain pulses 92 and 94 to be applied to the Y electrode so that an address discharge is caused to occur more certainly.

Moreover, an address pulse 99 is applied also to a cell to which no scan pulse has been applied during the address period. If the amount of residual wall charges during the reset period is increased, the possibility is increased that a discharge between the Y electrode to which no scan pulse has been applied and the address electrode, that is, an erroneous address discharge, is caused to occur. Therefore, the possibility of the occurrence of an erroneous address discharge is reduced by making the voltage of the address pulse 99 smaller. To be specific, the voltage (the difference between the final potential of the compensation obtuse wave 86 and the potential (zero, here) of the address electrode) to be applied between the Y electrode and the address electrode at the time of the adjustment of residual charges during the reset period is made larger than the difference between the potential of the Y electrode to which no scan pulse has been applied during the address period and the potential of the address pulse. As the discharge between the Y electrode and the address electrode is completed by the application of the final potential of the compensation obtuse wave 86, no discharge is caused to occur even if a voltage smaller than the above-mentioned voltage at the time of the adjustment of residual charges, thus an erroneous address discharge is prevented from being caused to occur.

Moreover, the waveforms during the sustain discharge period are different as follows. In the first embodiment, after the charge adjusting pulse 55 is applied at the end of the address period, a sustain pulse is applied simultaneously to the odd-numbered and even-numbered X electrodes X1 and X2, and the odd-numbered and even-numbered Y electrodes Y1 and Y2. In contrast to this, in the fifth embodiment, after a charge adjusting pulse 89 is applied, sustain pulses 75 and 90 are applied to the odd-numbered X electrode X1 and the odd-numbered Y electrode Y1 but the sustain pulses are not applied to the even-numbered electrode X2 and the even-numbered Y electrode Y2, and then sustain pulses 76 and 91 are applied to the even-numbered X electrode X2 and the even-numbered Y electrode Y2 but the sustain pulses are not applied to the odd-numbered X electrode X1 and the odd-numbered Y electrode Y1. This is because the amount of wall charges is made equal to the amount of wall charges formed by the first sustain pulse.

Further, a sustain pulse 77 and the sustain pulse 92 are applied to the odd-numbered X electrode X1 and the odd-numbered Y electrode Y1 but the sustain pulses are not applied to the even-numbered X electrode X2 and the even-numbered Y electrode Y2. After this, the sustain pulses are applied simultaneously to the odd-numbered and even-numbered X electrodes X1 and X2, and the odd-numbered and even-numbered Y electrodes Y1 and Y2, and this is repeated. Then, the final sustain pulses are applied to the even-numbered X electrode X2 and the even-numbered Y electrode Y2 but are not applied to the odd-numbered X electrode X1 and the odd-numbered Y electrode Y1. This is to adjust the polarity of the sustain discharge and to make equal the number of sustain discharges relating thereto. Finally, a pulse 81 lower in voltage than the positive sustain voltage is applied to the X electrode and simultaneously a pulse 96 equal in voltage to the negative sustain voltage is applied to the Y electrode to cause a discharge to occur, thus the amount of residual wall charges formed by the sustain discharge is reduced to a certain extent. This discharge should be considered in relation to the luminance that contributes to gradated displays because it occurs only in the cells in which the sustain discharge has occurred, that is, only in the lit cells.

As the even numbered field can be explained in the similar manner, an explanation is not given here. In the above, the differences from the drive waveforms in the first embodiment are explained, but it is obvious that the normal operations can be expected with the drive waveforms in the first embodiment if there is a sufficient margin for the setting of conditions.

The shapes of the electrodes in the fifth embodiment shown in FIG. 21 are the same in each cell, but there can be various modifications and some of them are explained below with reference to FIG. 23 to FIG. 27.

In the fifth embodiment, only the longitudinal partitions are provided, therefore, there is the possibility of the occurrence of an after display because a sustain discharge spreads in the vertical direction. Moreover, when the distance between the facing edges of the X and Y discharge electrodes 13 and 11 increases, the position the center of light emission in a cell is shifted from the center. This means that the position at which light emission is initiated is also shifted. If the center of light emission is shifted and light emission spreads in the vertical direction, that is, light emission spreads to a position where light emission is more likely to occur, and an erroneous display is more likely to occur when the shapes are as shown in FIG. 21. If, as shown in FIG. 23, the direction in which the distance between the facing edges of the X and Y discharge electrodes 13 and 11 increases in a cell is made opposite to that in the cell vertically adjacent thereto, in the upward or downward direction, the possibility of the occurrence of such an erroneous display can be reduced because the centers of light emission in the upper and lower cells are shifted in the opposite directions.

Figure 24:
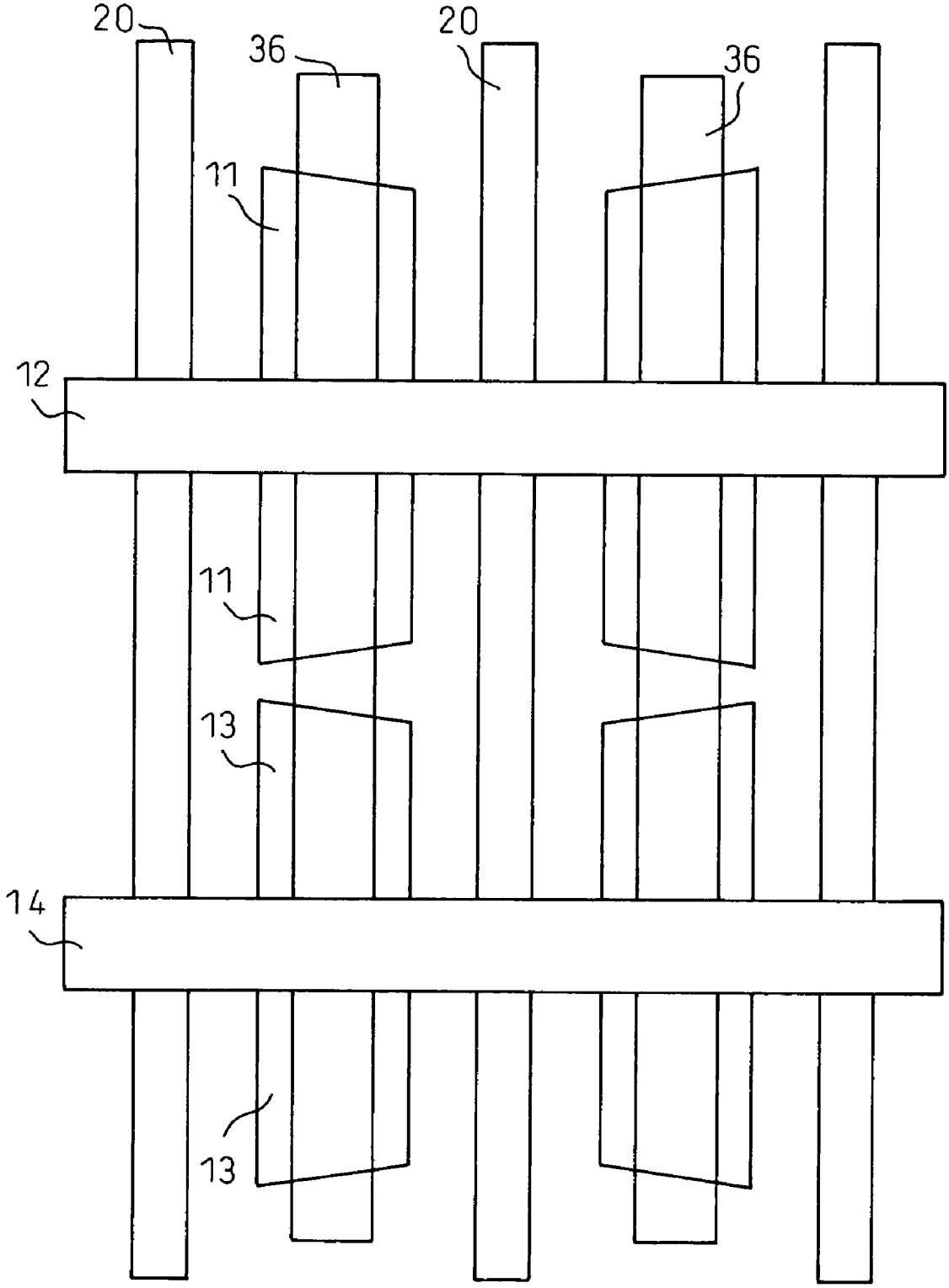
FIG. 24 is a diagram showing another example of a modification of the shape of electrodes in the PDP according to the fifth embodiment.

If the center of light emission in a cell is shifted, the visual angle characteristic is adversely affected. Hence, as shown in FIG. 24, the direction in which the distance between the facing edges of the X and Y discharge electrodes 13 and 11 increases in a cell is made opposite to that in the cell transversely adjacent thereto in the rightward or leftward direction. Due to this, the direction in which the center of light emission is shifted in a cell is made to differ from that in the cell transversely adjacent thereto, therefore, the centers of light emission can be prevented from being shifted in one direction and the visual angle characteristic is improved because the shifts in the position of the center of light emission are averaged in the entire panel.

Figure 23:
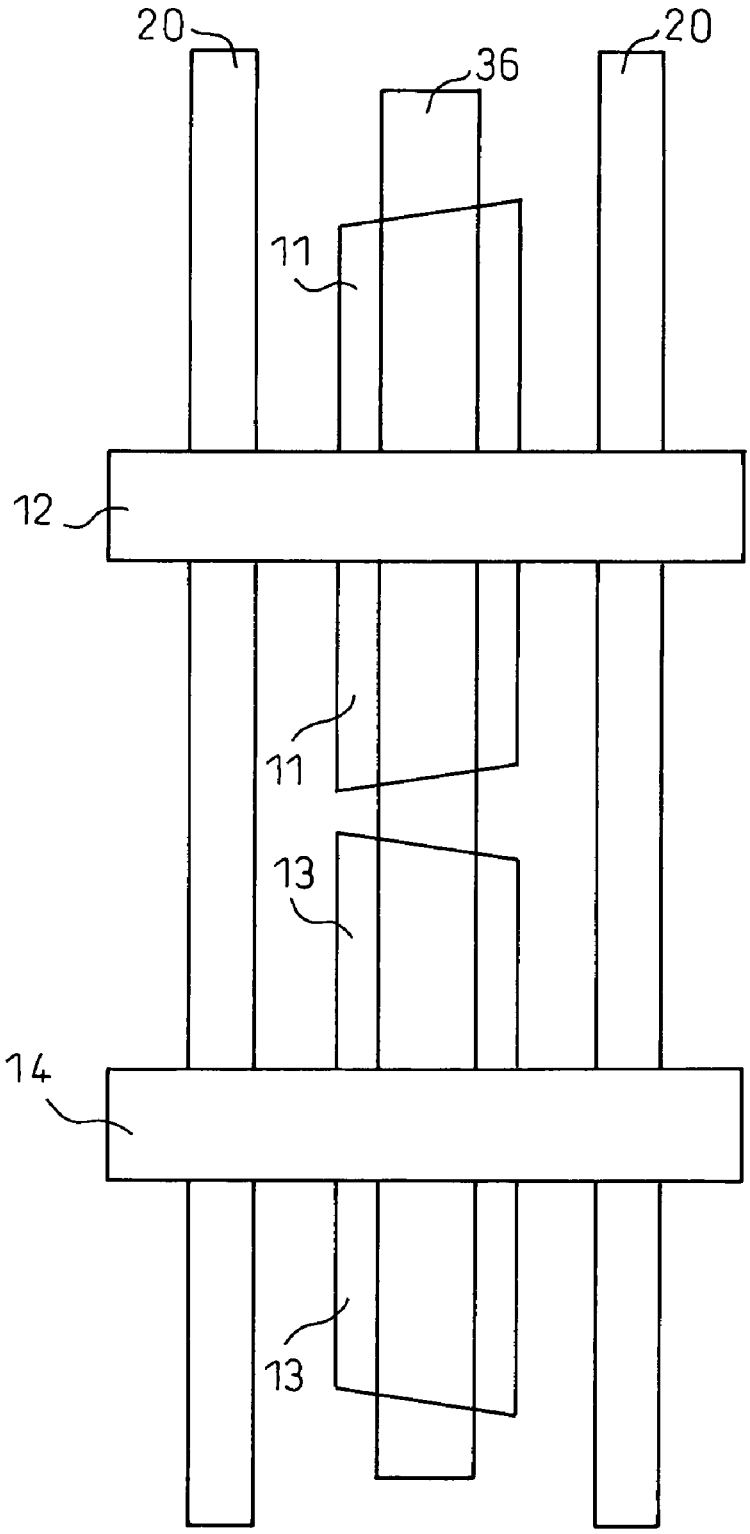
FIG. 23 is a diagram showing an example of a modification of the shape of electrodes in the PDP according to the fifth embodiment.
Figure 25:
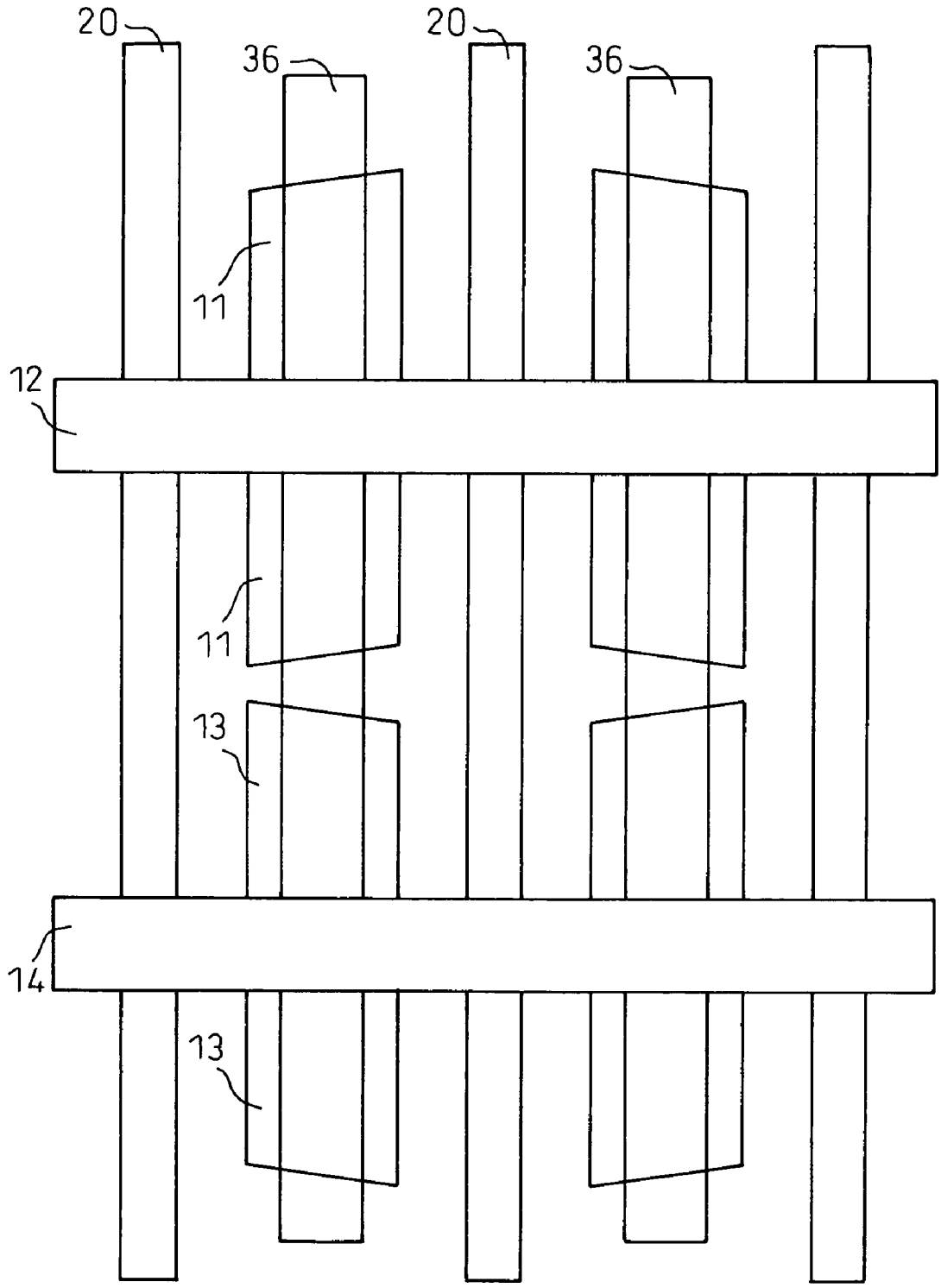
FIG. 25 is a diagram showing another example of a modification of the shape of electrodes in the PDP according to the fifth embodiment.

FIG. 25 shows the shapes when both the modifications shown in FIG. 23 and FIG. 24 are made, wherein the direction in which the distance between the facing edges of the X and Y discharge electrodes 13 and 11 increases in a cell is made opposite to that in the cell vertically or transversely adjacent thereto in the upward or downward direction or in the rightward or leftward direction, thus both effects can be obtained.

Figure 26:
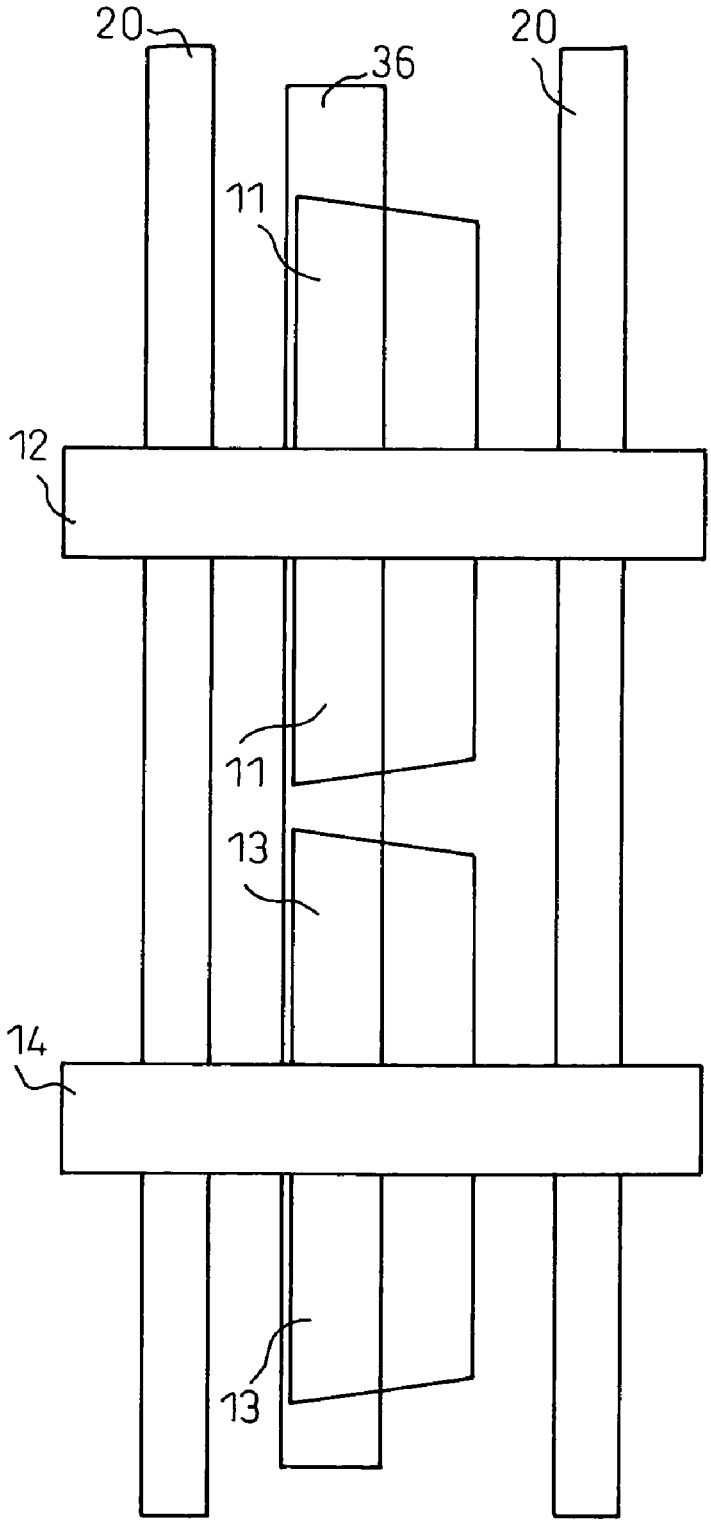
FIG. 26 is a diagram showing another example of a modification of the shape of electrodes in the PDP according to the fifth embodiment.

Moreover, as shown in FIG. 26, by shifting the position of the address electrode 36 in the direction toward shorter distances between the facing edges of the X and Y discharge electrodes 13 and 11, the area of the Y discharge electrode 11 facing the address electrode can be increased, therefore, an address discharge can be made more likely to occur. This configuration, however, cannot be applied to the modifications shown in FIG. 23 and FIG. 25.

Figure 27:
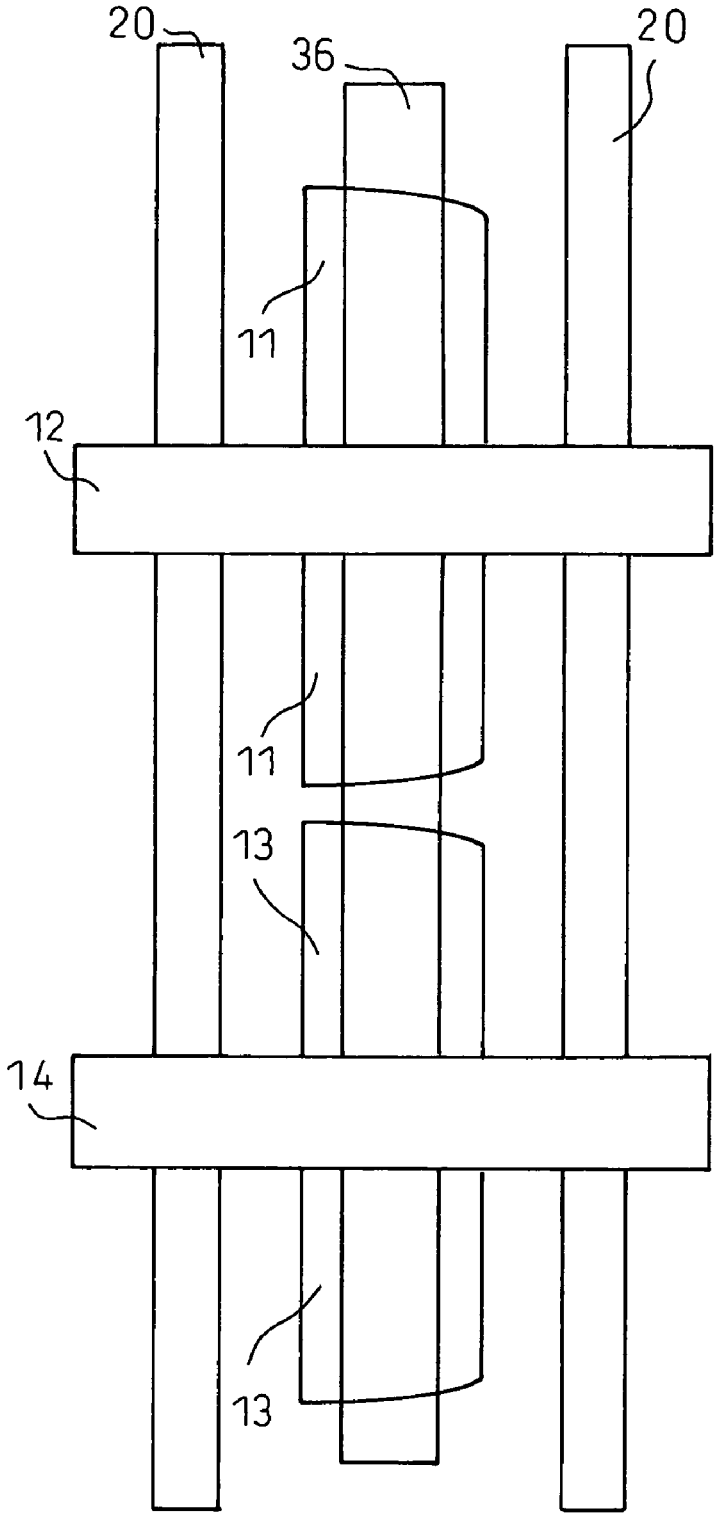
FIG. 27 is a diagram showing another example of a modification of the shape of electrodes in the PDP according to the fifth embodiment.

FIG. 27 is a diagram showing another modification of the shapes of the electrodes in the fifth embodiment, wherein the facing edges of the X and Y discharge electrodes 13 and 11 are curved and the change in distance is smaller in the direction toward the shorter distances and is large in the direction toward the longer distances. Due to this, it is possible to set the Paschen minimum certainly even when the setting errors are large.

The fifth embodiment of the present invention was explained as above. Like the third embodiment, the present invention can be applied to the case where the address electrodes are provided on the back substrate in the conventional PDP not employing the ALIS system, in which the display line is defined only between one side of the X electrode and one side of the adjacent Y electrode facing thereto, and is not defined between the other side of the X electrode and one side of the other adjacent Y electrode facing thereto.

The embodiments of the present invention are explained as above. There can be various modifications of the present invention, and it is possible to combine each configuration and modification explained in the first to fifth embodiments with a configuration or modification in the other embodiments. For example, the configuration explained in the fifth embodiment, where the direction in which the distance between the facing edges increases in a cell is made opposite to that in a cell vertically or transversely adjacent thereto, can also be applied to the first to fourth embodiments. Conversely, the shapes of the X and Y electrodes in the first to fourth electrodes can also be applied to the fifth embodiment. Moreover, part of the drive waveforms in the first and fifth embodiments can be also applied to other embodiments.

According to the present invention, as explained above, it is not only possible to reduce the discharge voltage but it is also possible to make the discharge start voltage uniform in each cell despite the variations in distance between electrodes caused during manufacture.

Moreover, the present invention brings about the effects that the degree of freedom in designing the structure of the back substrate (the second substrate) is increased, the life is improved, the luminance is increased, the manufacturing process is simplified, the drive circuit is simplified, the discharge control is stabilized, etc.

Still moreover, the present invention makes it possible to make the discharge start voltage uniform in each cell and, therefore, the discharge start voltage can be set low and the cost of the circuit can be reduced. Further, as the structure of the panel can be simplified, the manufacturing cost can be reduced. As a result, it is possible to realize a PDP apparatus with an excellent display quality at a low cost.

We claim:

1. A plasma display panel, comprising:

a first substrate;

a second substrate arranged so as to face the first substrate and forming discharge spaces in which a discharge gas is enclosed between the second substrate and the first substrate;

a plurality of cells formed in the discharge spaces and in which a discharge is caused to occur selectively for display; and a pair of electrodes provided in each of the plurality of cells, respectively, and controlling the discharge, the pair of electrodes comprising edges facing each other for causing a discharge to occur, the distance between the facing edges changing as viewed from a direction perpendicular to the first and second substrates, and the edges have substantially a same shape in each of the plurality of cells, wherein the pair of electrodes comprises:

a first electrode comprising a first bus electrode provided on the first substrate and a first discharge electrode provided so as to be connected to the first bus electrode, and a second electrode comprising a second bus electrode provided on the first substrate and a second discharge electrode provided so as to be connected to the second bus electrode, and third electrodes are further provided on a dielectric layer covering the first and second electrodes on the first substrate comprising:

a third bus electrode extending in a direction substantially perpendicular to the direction in which the first and second bus electrodes extend so as to intersect the first and second bus electrodes, and a third discharge electrode provided so as to be connected to the third bus electrode, and wherein the second discharge electrode and the third discharge electrode have facing edges and a distance between the edges changes when viewed from a direction perpendicular to the first and second substrates, and wherein the second discharge electrode and the third discharge electrode have edges facing each other and the distance between the edges changes stepwise.

2. A plasma display panel, comprising:

a first substrate;

a second substrate arranged so as to face the first substrate and forming discharge spaces in which a discharge gas is enclosed between the second substrate and the first substrate;

a plurality of cells formed in the discharge spaces and in which a discharge is caused to occur selectively for display; and a pair of electrodes provided in each of the plurality of cells, respectively, and controlling the discharge, the pair of electrodes comprising edges facing each other for causing a discharge to occur, the distance between the facing edges changing as viewed from a direction perpendicular to the first and second substrates, and the edges have substantially a same shape in each of the plurality of cells, wherein the pair of electrodes comprises:

a first electrode comprising a first bus electrode provided on the first substrate and a first discharge electrode provided so as to be connected to the first bus electrode, and a second electrode comprising a second bus electrode provided on the first substrate and a second discharge electrode provided so as to be connected to the second bus electrode, and third electrodes are further provided on a dielectric layer covering the first and second electrodes on the first substrate comprising:

a third bus electrode extending in a direction substantially perpendicular to the direction in which the first and second bus electrodes extend so as to intersect the first and second bus electrodes, and a third discharge electrode provided so as to be connected to the third bus electrode, and wherein the second discharge electrode and the third discharge electrode have facing edges and a distance between the edges changes when viewed from a direction perpendicular to the first and second substrates, and wherein the second discharge electrode and the third discharge electrode have curved edges facing each other.

3. A plasma display panel, comprising:

a first substrate;

a second substrate arranged so as to face the first substrate and forming discharge spaces in which a discharge gas is enclosed between the second substrate and the first substrate;

a plurality of cells formed in the discharge spaces and in which a discharge is caused to occur selectively for display; and a pair of electrodes provided in each of the plurality of cells, respectively, and controlling the discharge, the pair of electrodes comprising edges facing each other for causing a discharge to occur, the distance between the facing edges changing as viewed from a direction perpendicular to the first and second substrates, and the edges have substantially a same shape in each of the plurality of cells, wherein the pair of electrodes comprises:

a first electrode comprising a first bus electrode provided on the first substrate and a first discharge electrode provided so as to be connected to the first bus electrode, and a second electrode comprising a second bus electrode provided on the first substrate and a second discharge electrode provided so as to be connected to the second bus electrode, and third electrodes are further provided on a dielectric layer covering the first and second electrodes on the first substrate comprising:

a third bus electrode extending in a direction substantially perpendicular to the direction in which the first and second bus electrodes extend so as to intersect the first and second bus electrodes, and a third discharge electrode provided so as to be connected to the third bus electrode, and wherein the second discharge electrode and the third discharge electrode have facing edges and a distance between the edges changes when viewed from a direction perpendicular to the first and second substrates, and wherein the corners of the second discharge electrode and the third discharge electrode, at which the distance between the facing edges is a minimum, are curved.

4. The plasma display panel as set forth in claim 3, wherein the thickness of the dielectric layer is less than or equal to 10 μm.

5. A plasma display panel, comprising:

a first substrate;

a second substrate arranged so as to face the first substrate and forming discharge spaces in which a discharge gas is enclosed between the second substrate and the first substrate;

a plurality of cells formed in the discharge spaces and in which a discharge is caused to occur selectively for display; and a pair of electrodes provided in each of the plurality of cells, respectively, and controlling the discharge, the pair of electrodes comprising edges facing each other for causing a discharge to occur, the distance between the facing edges changing as viewed from a direction perpendicular to the first and second substrates, and the edges have substantially a same shape in each of the plurality of cells, wherein the pair of electrodes comprises:

a first electrode comprising a first bus electrode provided on the first substrate and a first discharge electrode provided so as to be connected to the first bus electrode, and a second electrode comprising a second bus electrode provided on the first substrate and a second discharge electrode provided so as to be connected to the second bus electrode, and third electrodes are further provided on a dielectric layer covering the first and second electrodes on the first substrate comprising:

a third bus electrode extending in a direction substantially perpendicular to the direction in which the first and second bus electrodes extend so as to intersect the first and second bus electrodes, and a third discharge electrode provided so as to be connected to the third bus electrode, and wherein the second discharge electrode and the third discharge electrode have facing edges and a distance between the edges changes when viewed from a direction perpendicular to the first and second substrates, and wherein the widths of the intersections of the first bus electrode and the second bus electrode with the third bus electrode are narrower than those of other parts.

* * * * *

UNITED STATES PATENT AND TRADEMARK OFFICE

CERTIFICATE OF CORRECTION

PATENT NO. : 7,521,867 B2
APPLICATION NO. : 10/936698
DATED : April 21, 2009
INVENTOR(S) : Takashi Sasaki et al.

It is certified that error appears in the above-identified patent and that said Letters Patent is hereby corrected as shown below:

On the Title Page, Item (54) (Title), Line 2, after "DRIVING" insert --,--.

Column 1 , Line 2, after "DRIVING" insert --,--.

Signed and Sealed this

Eighth Day of September, 2009

David J. Kappos

David J. Kappos
*Director of the United States Patent and Trademark Office*